US012631106B2

(12) United States Patent
Nourdeen et al.

(10) Patent No.: US 12,631,106 B2
(45) Date of Patent: May 19, 2026

(54) PRODUCING OIL AND GAS

(71) Applicant: Saudi Arabian Oil Company, Dhahran (SA)

(72) Inventors: Hasan A. Nourdeen, Dhahran (SA); Ahmad F. Khamees, Al Qatif (SA); Abdulrahman Albukhari, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/761,438

(22) Filed: Jul. 2, 2024

(65) Prior Publication Data

US 2026/0009323 A1 Jan. 8, 2026

(51) Int. Cl.
*E21B 43/14* (2006.01)
*E21B 47/06* (2012.01)
*E21B 47/10* (2012.01)

(52) U.S. Cl.
CPC ..... *E21B 47/10* (2013.01); *E21B 47/06* (2013.01)

(58) Field of Classification Search
CPC ..... E21B 34/025; E21B 43/12; E21B 43/14; E21B 43/34; E21B 47/06; E21B 49/00
See application file for complete search history.

(56) References Cited

U.S. PATENT DOCUMENTS 9,864,353 B2 * 1/2018 Tonkin ..... G05B 15/02
10,337,283 B2 * 7/2019 Gottumukkala ..... E21B 34/06
10,443,359 B2 * 10/2019 DeValve ..... E21B 43/16
11,441,390 B2 * 9/2022 AlQahtani ..... E21B 34/16
11,441,395 B2 * 9/2022 Alanazi ..... E21B 43/14
11,448,046 B2 * 9/2022 Alghazali ..... G06F 3/04842
(Continued)

FOREIGN PATENT DOCUMENTS

AU 2016271165 1/2018
WO WO 2016195846 12/2016

OTHER PUBLICATIONS

Ibrahim et al., "Applications of Artificial Intelligence to Predict Oil Rate for High Gas-Oil Ratio and Water-Cut Wells," ACS Omega, Jul. 20, 2021, 6(30):19484-19493, 10 pages.
(Continued)

*Primary Examiner* — Kenneth L Thompson
(74) *Attorney, Agent, or Firm* — Fish & Richardson P.C.

(57) ABSTRACT

A method for determining fluid production rates in a high gas-oil-ratio environment from a multilateral well that includes receiving pressure and flow rate data from the multilateral well at multiple choke valve settings. The multilateral well produces multiple fluids from a reservoir. The method includes determining a calibrated inflow performance relationship and a calibrated vertical lift performance relationship. For each sensitivity case of multiple sensitivity cases, the method includes determining a simulated operating point based on the calibrated relationships and the sensitivity case. The method includes measuring, during fluid production, a flowing bottom hole pressure, a surface pressure, and a reservoir pressure. The method includes predicting flow rates of at least one fluid produced by the multilateral well based on an output of an optimizer and modifying, based on the predicted flow rates, one or more properties of the multilateral well to optimize a respective fluid production rate.

16 Claims, 11 Drawing Sheets

(56) References Cited

U.S. PATENT DOCUMENTS

| | | | | |
|---|---|---|---|---|
| 11,499,423 | B2 * | 11/2022 | Alanazi | E21B 41/0035 |
| 11,719,856 | B2 | 8/2023 | Liu et al. | |
| 11,808,149 | B2 | 11/2023 | Syresin et al. | |
| 2021/0310345 | A1 | 10/2021 | Aqeel et al. | |
| 2023/0184061 | A1 | 6/2023 | Alkhalaf et al. | |
| 2024/0218768 | A1 * | 7/2024 | Shaker | E21B 43/14 |

OTHER PUBLICATIONS

Wilson, "Machine Learning for Well Rate Estimation: Integrated Imputation and Stacked Ensemble Modeling," Thesis for the degree of Master of Engineering in System Design and Management, Massachusetts Institute of Technology, Sep. 2020, 118 pages.

* cited by examiner

PRODUCING OIL AND GAS

TECHNICAL FIELD

The present disclosure relates to producing oil and gas including estimating fluid rates during oil and gas production.

BACKGROUND

Oil and gas production is a process that involves several phases including exploration, drilling into a subsurface, well completion, oil and gas extraction, and processing. Oil and gas exploration involves geological and geophysical methods to identify hydrocarbon-rich subsurface formations. Drilling into the subsurface includes employing machinery to create wells in the subsurface to access hydrocarbons. In some cases, well completion involves casing and cementing the wells to facilitate the extraction of the hydrocarbons. Once hydrocarbons are accessed, production systems harness techniques like artificial lift to optimize the flow of oil and gas. The extracted fluids are processed to separate oil, gas, and water, followed by transportation through pipelines or tankers to refineries or distribution centers.

Quantifying oil, water, and gas production rates from oil and gas wells is a historical challenge across the oil and gas industry. Several technologies and methodologies have demonstrated various degrees of success that depend on particular oil and gas production complexities. The complexities include reservoir heterogeneity, reservoir location, e.g., onshore, or offshore, and the types of fluids that are produced from the reservoir simultaneously. Accurately estimating well production rates is essential for many reasons, such as meeting a field's production target, allocating production from different wells, conducting reservoir and well simulation and history matching, and designing new production facilities.

SUMMARY

This specification describes techniques that can be used for estimating flow rates of fluids extracted from a multilateral well. Fluids extracted from multilateral wells often include oil, gas, and water. Estimating fluid production rates is important for controlling one or more wells to meet a particular production target, allocating production between wells within a field, conducting reservoir and well simulations, and designing new production facilities. This specification describes techniques that model the fluid flow from a reservoir through a multilateral well in a high gas-oil-ratio environment. The techniques include modeling the physical system with a nodal analysis, generating multiple simulated sensitivity cases that cover an operational range of parameters that can correspond to multiple wells in a particular oil field, and implementing an optimization technique to estimate fluid production rates for each fluid produced by the reservoir based on the sensitivity cases and an output of the nodal analysis.

The system described here implements a series of measurements and determinations that result in an estimation of fluid production rates of oil, gas, and water based on readily available pressure data associated with a particular well. As pressure data is available without having to re-route fluids through a measurement device, the system provides a real-time estimation of fluid flow rates during production from a reservoir by a multilateral well.

Implementations of the systems and methods of this disclosure can provide various technical benefits. Continuous estimation of fluid production rates from a reservoir produced by a multilateral well allows for improved accuracy of month-end production allocation from wells in a particular oil field. Wells experience production fluctuations over time that are captured by monitoring the production rate continuously through real-time pressure measurements of the well. The systems and methods described in this disclosure can be implemented to establish a relationship between parameters that are based on physical flow of fluids through the reservoir and the multilateral well that are valid in a high gas-oil-ratio environment, and production flow rates. The relationships can include an inflow performance relationship, a vertical lift performance relationship, and ideal well operating points. The use of physical models of the well and of fluids to predict flow rates based on pressure measurements can provide accurate flow rate estimations in high gas-oil-ratio environments.

In addition, the systems and methods described in this disclosure can be implemented based on data from a single well, without a need for data from multiple wells in a field or complex geological data. A physical model of the single well and an associated reservoir is generated and calibrated based on pressure and flow rate data and can adapt to changing environments over time to provide ongoing flow rate predictions for the particular well.

The details of one or more implementations of these systems and methods are set forth in the accompanying drawings and the description below. Other features, objects, and advantages of these systems and methods will be apparent from the description and drawings, and from the claims.

DESCRIPTION OF DRAWINGS

Like reference numbers and designations in the various drawings indicate like elements.

DETAILED DESCRIPTION

This specification describes techniques that can be used for estimating flow rates of fluids extracted from a multilateral well.

The techniques described in this specification offer an alternative to periodically evaluating flow rates of fluids extracted from an oil and gas reservoir by a multilateral well with surface flow meters or portable fluid separators.

Fluids extracted from multilateral wells often include oil, gas, and water. Estimating fluid production rates is important for controlling one or more wells to meet a particular production target, allocating production between wells within a field, conducting reservoir and well simulations, and designing new production facilities. This specification describes techniques that model the fluid flow from a reservoir through a multilateral well in a high gas-oil-ratio environment. The techniques include modeling the physical system with a nodal analysis, generating multiple simulated sensitivity cases that cover an operational range of parameters that can correspond to multiple wells in a particular oil field, and implementing an optimization technique to estimate fluid production rates for each fluid produced by the reservoir based on the sensitivity cases and nodal analysis.

The system described here implements a series of measurements and determinations that can provide an estimation of fluid production rates of oil, gas, and water based on readily available pressure data associated with a particular well. As pressure data is available without having to re-route fluids through a measurement device, the system can provide a real-time estimation of fluid flow rates from production from a reservoir through a multilateral well.

Figure 1:
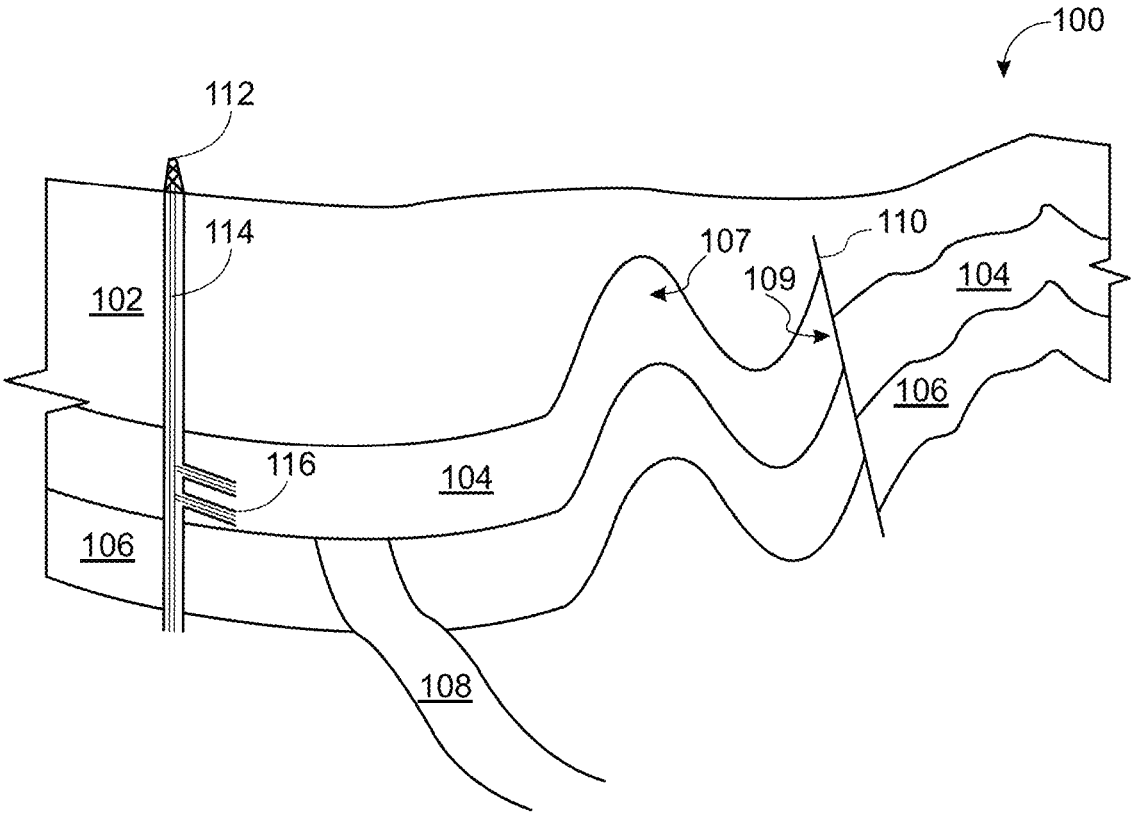
FIG. 1 is a schematic view of a system for extracting hydrocarbons from a subterranean region.

FIG. 1 is a schematic view of a multilateral well configured to extract hydrocarbons from a subterranean region 100, the region including features such as facies and faults. The subterranean formation 100 includes a layer of impermeable cap rocks 102 above the hydrocarbon accumulation. Facies underlying the impermeable cap rocks 102 include a sandstone layer 104, a limestone layer 106, and a sand layer 108. A fault line 110 extends across the sandstone layer 104 and the limestone layer 106.

Oil and gas tend to rise through permeable reservoir rock until further upward migration is blocked, for example, by the layer of impermeable cap rock 102. Various approaches attempt to identify locations where interaction between layers of the subterranean formation 100 are likely to trap oil and gas by limiting this upward migration. For example, FIG. 1 shows an anticline trap 107, where the layer of impermeable cap rock 102 has an upward convex configuration, and a fault trap 109, where the fault line 110 might allow oil and gas to flow in with clay material between the walls traps the petroleum. Other traps include salt domes and stratigraphic traps.

A wellhead 112 and related components, e.g., pumps, hydrocarbon storage facilities, fluid analyzers, computing devices etc., are positioned at the surface of the subterranean formation 100. A wellbore and tubing 114, e.g., pipe, casing, etc., extend from the surface downward through the layers of the subterranean formation 100. In some cases, several lateral wells extend from the tubing 114 to access hydrocarbon reservoirs at various depths and horizontal displacements. For example, the lateral well 116 is configured to extract fluids from the formation 100 at a lateral displacement relative to the main tubing 114. Each lateral well, e.g., the lateral well 116, is configured to couple to a main well that guides the collected fluids to the surface-level wellhead 112.

Figure 2:
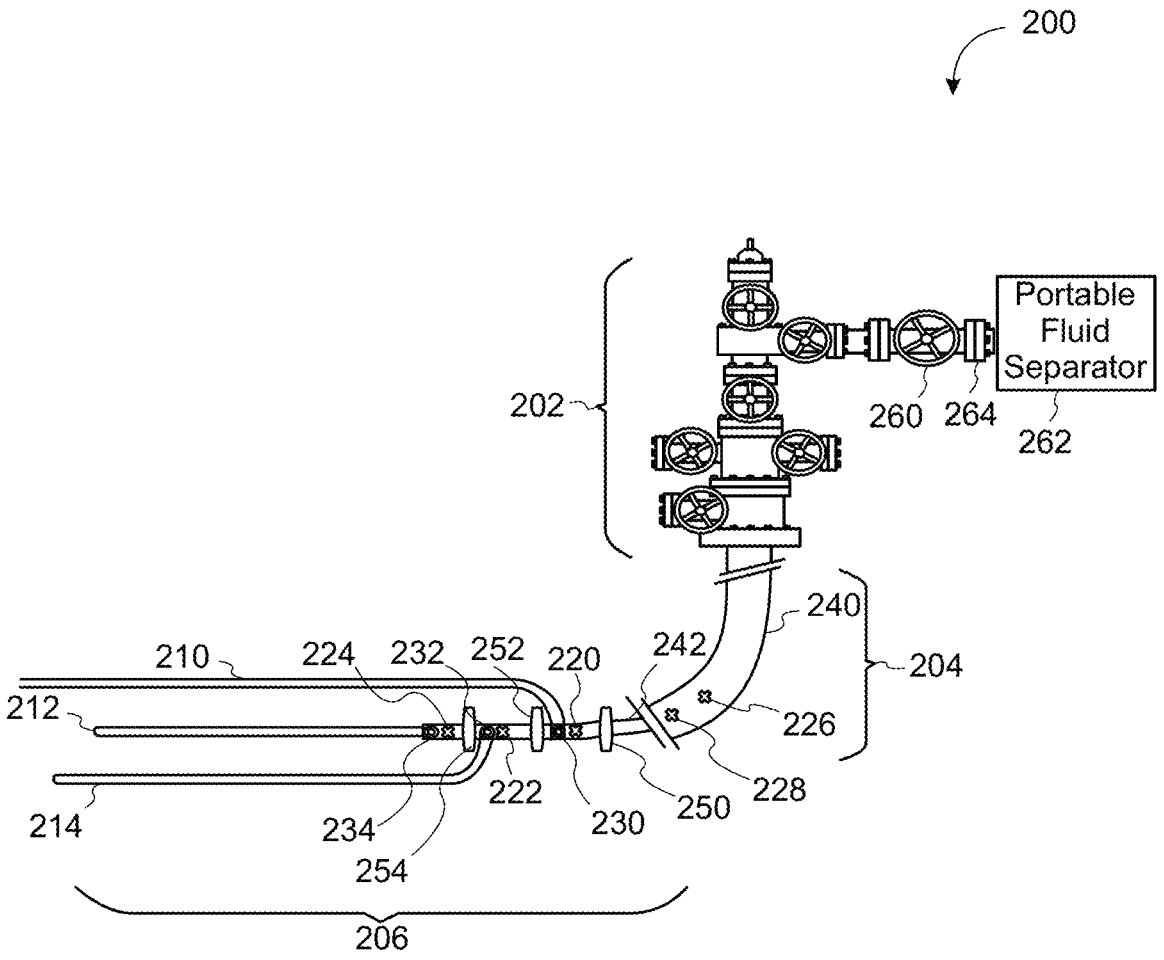
FIG. 2 is an example multilateral well.

FIG. 2 is an example multilateral well 200. The multilateral well 200 includes three segments. A first segment is a surface-level wellhead 202 segment that includes one or more valves and tubing that can control the flow of fluids extracted from the well. A second segment 204 below the first segment includes a common tubing 240 that extends into a subsurface region and one or more pressure gauges (e.g., pressure gauges 226 and 228). A third segment 206 includes multiple lateral wells (e.g., lateral wells 210-214) and a common tubing 242, in which the common tubing 242 receives fluid from each lateral well 210-214 at different locations along the common tubing 242. The common tubing 240 of the second segment 204 receives the fluids from the common tubing 242, in which the fluids that originate from each lateral well 210-214 are combined. The common tubing 240 guides the fluids to the surface components, including valves and the wellhead 202 located at the surface.

Each lateral well 210-214 facilitates an extraction of fluid from a different section of a subsurface reservoir. For example, the multilateral well 200 includes three lateral wells, in which the lateral well 210 facilitates extraction of fluid from a section of the reservoir closer to the surface in comparison with the lateral well 212 and the lateral well 214.

The lateral wells 210-214 are each coupled to the common tubing 242. A respective inflow control valve (e.g., inflow control valves 230-234) controls the flow of fluids from each lateral well at the junction between the lateral well and the common tubing 242. A pressure gauge (e.g., pressure gauges 220-224) is positioned at each junction between the common tubing 242 and a respective lateral well. For example, the pressure gauge 224 measures the pressure in the common tubing 242 due to fluid from the lateral well 212. The pressure gauge 222 measures the pressure in the common tubing 242 due to fluid from the lateral wells 212-214. The pressure gauge 220 measures the pressure in the common tubing 242 due to the fluid from the lateral wells 212-216. In other words, the pressure gauge that corresponds to the lateral well that joins the common tubing 242 closest to the wellhead 202 corresponds to the pressure due to all of the fluid extracted from the reservoir across all lateral wells.

In some implementations, pressure gauge measurements and inflow control valve settings are controlled by a computing device located at the surface. In some cases, the gauges and valves are communicatively coupled with a computing device at the surface through a direct electrical connection through the tubing.

The components of the surface-level wellhead 202 include a choke valve 260. The choke valve 260 restricts the flow of fluid to control the flow rate. In some implementations, the surface flow rate affects downhole pressure, as measured by the pressure gauges 220-224. In some cases, the surface-level wellhead 202 includes other valves that can open and close alternative pipelines for evaluation and/or hydrocarbon production purposes.

The common tubing 240 includes one or more pressure gauges, e.g., pressure gauges 226-228. The pressure gauges 226-228 are configured to measure pressure of fluid flowing through the common tubing 240 and are positioned at various depths of the multilateral well 200. For example, a pressure gauge can be positioned towards the top of the multilateral well near the surface-level wellhead 202 or near the lateral wells 210-214 near the subsurface reservoir.

The multilateral well 200 includes packers, e.g., packers 250-254, which are mechanical devices that expand to form a tight seal against the wellbore or casing of each lateral. When placed between different laterals at points where they diverge from the common tubing 242 or along the lateral itself, packers isolate the fluid production zones by creating a physical barrier, so the production of fluids from each lateral 210-214 is isolated. In some implementations, packers are not implemented as part of the well completion steps, and fluid extraction from each lateral 210-214 is allowed to comingle. However, a primary goal of completing a well using packers is to control fluid flow so that water or gas breakthrough in one zone does not impact the production characteristics of neighboring zones or laterals.

A portable fluid separator 262 is configured to receive the fluid from a wellhead port 264 that is configured to receive the fluid from the choke valve 260. The portable fluid separator 262 is a measurement device for separating one or more fluid types, e.g., oil, gas, and water, from the fluid flowing into the surface-level wellhead 202. In many cases, the portable fluid separator 262 is temporarily installed to evaluate the fluid rates of each fluid and is transported among multiple wells in a region.

In some implementations, one or more calculations based on pressure measurements from the pressure gauges 220-224 require an inflow reference depth to standardize an analysis of flow rates that are comingled from each of the lateral wells 210-214. For example, the pressure measured by the pressure gauge 224 corresponds to the fluid flowing through only the lateral well 212. Similarly, the pressure measured by the pressure gauge 222 corresponds to the fluid flowing from both the lateral well 212 and the lateral well 214. However, in some cases, the respective pressure gauges are positioned at different elevations, e.g., different distances from the surface-level wellhead 202. The inflow reference depth is determined to be the depth of a pressure gauge that is associated with a lateral well that is closest to the surface-level wellhead 202. In the example illustrated in FIG. 2, the inflow reference depth corresponds to the depth of the inflow control valve 230, which is associated with the lateral well 210 and is the closest inflow control valve to the surface-level wellhead 202 in comparison with the valves associated with the other lateral wells 212-214. Each pressure measurement associated with the pressure gauges 222-224 is extrapolated to be associated with the inflow reference depth based on a hydrostatic fluid gradient inside the tubing, which describes the different in pressure between two vertically displaced locations within the tubing.

Figure 3:
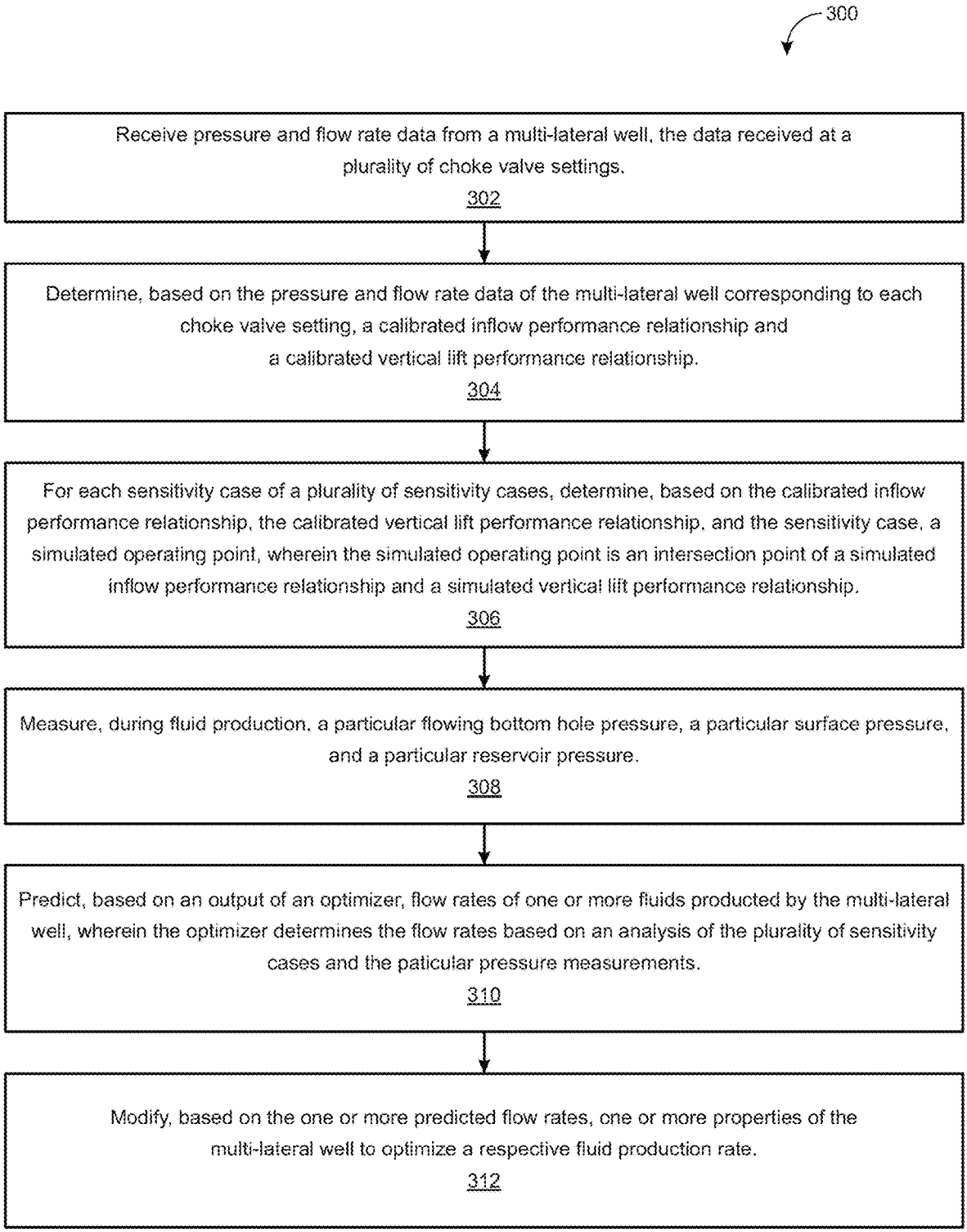
FIG. 3 is a flow diagram of an example process for determining fluid production rates from a multilateral well.

FIG. 3 is a flow diagram of an example process 300 for determining fluid production rates from a multilateral well. For clarity of presentation, the description that follows generally describes process 300 in the context of the other figures in this description. In some implementations, various steps of process 300 can be performed in parallel, in combination, in loops, or in any order.

The system determines (302) pressure and flow rate data from a multilateral well at a plurality of choke valve settings. A choke valve, e.g., the choke valve 260 of FIG. 2, controls a flow rate of fluids that are received by a common tubing, e.g., the common tubing 240 of FIG. 2. In some implementations, the choke valve controls the flow of multiple fluids that are mixed in a common tubing, which can include hydrocarbon, e.g., oil and/or gas, water, and other fluids from a subsurface reservoir.

Pressure data are obtained by pressure gauges that are configured to measure the pressure of the internal region of a pipe or tubing. The pressure gauges can be positioned on various components of the multilateral well. For example, pressure gauges can be positioned towards the bottom of the well, at a junction between a lateral well and a common tubing, to measure a flowing bottom hole pressure ("FBHP"). As another example, pressure gauges can be positioned on one or more lateral well to measure a static reservoir pressure, in which the static reservoir pressure is a pressure of the reservoir when no fluid is flowing through the lateral wells to the common tubing. The static reservoir pressure can be obtained by either shutting off the well by closing the choke valve at surface, or by closing each inflow control valve, e.g., the inflow control valves 230-234 of FIG. 2, resulting in zero fluid flow through the laterals from the reservoir in either case. As another example, pressure gauges can be positioned in a common tubing near the surface-level wellhead to determine a surface pressure.

Flow rate data of the multilateral well are obtained from a portable fluid separator, e.g., the portable fluid separator 262. The portable fluid separator separates a mixture of fluids extracted from the multilateral well into its constituent fluids. For example, the portable fluid separator can separate the fluids extracted from the well into three separate channels that include oil, water, and gas respectively. In some implementations, the portable fluid separator performs a three-phase separation, in which crude oil, water, and gas that are produced together from a well are separated. The separator achieves the separation through a combination of gravitational settling and other mechanical and/or chemical processes. Portable fluid separators are often used during well testing to measure the flow rates of oil, water, and gas separately.

The adjustable choke valve can be tuned to determine a flow rate, as measured by the portable fluid separator, of one or more fluids. The system can record pressure data from multiple pressure gauges, e.g., FBHP and surface pressure, as a function of the flow rate, as controlled by the choke valve setting and measured by the portable fluid separator.

Based on properties of the multilateral well and the reservoir, the system performs a nodal analysis of the multilateral well, in which the nodal analysis considers multiple segments of the system that guides the fluid from the reservoir to the surface-level wellhead. For example, nodal analysis allows for detailed analysis of how fluid flows from the reservoir to each lateral well of the multilateral well. In addition, nodal analysis allows for a separate detailed analysis of how fluid flows through the wellbore and up to the surface equipment. In particular, the nodal analysis can include a separate description of fluid flow in the reservoir, in the lateral wells, at various points of the common tubing, and at the wellhead. At each node, e.g., each segment of the system, parameters like pressure, temperature, and flow rate are evaluated to understand how they influence the overall system performance.

In general, the nodal analysis of the multilateral well includes processing input data that include well architecture, e.g., well completion data, reservoir fluid data, and flow rate data. The well architecture data is indicative of a mechanical design of the well which includes a trajectory of the well, dimensions of the well, and tube string sizes through which fluid is produced. Reservoir fluid data include PVT parameters like bubble point pressure, solution gas-oil-ratio, oil API, gas specific gravity, etc. Flow rate data include a rate-pressure relationship of wellhead flowing pressure, bottomhole flowing pressure, and surface production rates obtained from a portable fluid separator. Reservoir pressure is obtained in a static configuration, e.g., no fluid flow, either from the well or from one or more offset wells.

In some implementations, nodal analysis results in a physics-based model that is applicable to multiple well configurations and environmental conditions. Several steps are included in the creation of the physics-based model through a nodal analysis that considers environmental and operational differences between multiple sections of the multilateral well. In some cases, an analytical expression that describes a relationship between pressure and flow rate of multiple fluids can be derived. In some other cases, e.g., in a highly nonlinear system, an analytical expression is difficult to derive so numerical approaches are utilized.

The steps of creating a physics-based model include determining a well completion for a particular well. The well completion of the particular well can include a description of a particular well type, e.g., open hole, perforated casing, screen and liner, etc. In addition, the well completion can include particular production equipment including tubing, packers, valves, etc. In some implementations, the well completion details include reference depths for particular well components, e.g., gauges, valves, tubes, etc. In particular, an inflow reference depth as described in relation to FIG. 2 is used as a reference depth as a flow path reference depth for determining bottom hole pressures. To determine the inflow reference depth, a deviation survey, tubing string length, and geothermal gradient of the particular well are considered.

The steps include calibrating a fluid model of the fluids flowing from a reservoir through the particular well. Properties of the fluid impact the outputs of the physical model and require careful calibration of pressure-volume-temperature (PVT) data acquired in relation to the particular well. In some implementations, the system implements a fluid model that closely describes an expected type of fluid to flow from the reservoir. For example, a black oil model can be used to simplify the description of fluid to being composed primarily of oil, gas, and water, in which the gas can be dissolved in the oil depending on a temperature and pressure of the fluid. In some cases, the PVT data associated with the particular well is determined based on downhole fluid samples from multiple other wells in the field. PVT data can include gas-oil-ratio, oil API, gas specific gravity, formation water salinity, contaminants (e.g., $H_2S$, $CO_2$, and $N_2$) mole percentages, and a bubble-point pressure of the fluid.

In some implementations, determining (304) a calibrated inflow performance relationship and a calibrated vertical lift performance relationship first includes a consideration of an analytical representation of well operations. The analysis includes an efficiency analysis of extracting fluid from the reservoir by the multiple lateral wells, and an efficiency analysis of transporting the extracted fluid from the bottom of the well to the surface-level wellhead. In some implementations, the analytical representations are calibrated with the data collected as described by the previous step, e.g., determining (302) pressure and flow rate data. The calibration corrects, based on measured data associated with a particular well, for uncertainties present in the analytical representations of the physical system.

The system determines (304), based on the pressure and flow rate data of the multilateral well corresponding to each choke valve setting, a calibrated inflow performance relationship ("IPR"), and a calibrated vertical lift performance relationship ("VLP"). The physics-based model that considers the specifics properties of the well and the reservoir describe a baseline relationship between pressures and flow rates for multiple fluids, and the pressure and flow rate measurements that correspond to each choke valve setting, e.g., high flow, medium flow, and low flow, correct for uncertainties in the physics-based model to produce calibrated relationships.

An analytical correlation can be used to describe the IPR. In some cases, a particular analytical correlation performs better than other correlations depending on the environment in which it models. For example, Vogel's equation provides an analytical interpretation of the IPR for a well extracting fluid from a saturated reservoir with an initial reservoir pressure below the bubble-point pressure of oil. Vogel's equation is written as $$\frac{Q_0}{Q_{0,max}} = 1 - 0.8\left(\frac{p_{FBHP}}{p_{res}}\right) - 0.2\left(\frac{p_{FBHP}}{p_{res}}\right)^2,$$

in which $Q_0$ is a surface flow rate of oil, $Q_{0,max}$ is an absolute open flow potential ("AOFP"), $p_{FBHP}$ is the FBHP, and $p_{res}$ is the static reservoir pressure. The system determines the AOFP through a portable fluid separator, in which the multilateral well produces fluid at a low FBHP, often as close to atmospheric pressure as possible, to measure a maximum potential production rate. In general, as the surface flow rate increases, the corresponding FBHP decreases.

In some cases, a determination of the static reservoir pressure has a corresponding uncertainty. The uncertainty arises from the method of determining the static reservoir pressure in many cases. For example, the static reservoir pressure is often acquired by a closest offset well that extracts fluid from the same reservoir as the multilateral well. In some cases, the static reservoir pressure is acquired with a time delay, e.g., several months, compared to the other measurements, e.g., flow rates, that determine the IPR. Because of the uncertainty, the system can implement one or more calibration methods to offset the static reservoir pressure uncertainty. For example, the static reservoir pressure can be fine-tuned to fit the three empirical measurements of the IPR curve. In other words, the system can determine a more accurate estimation of the static reservoir pressure by comparing the output of the analytical representation by Vogel's equation with the empirical evaluation of the IPR through pressure and flow rate measurements.

The VLP of the multilateral well represents a relationship between the flow rate of fluids, e.g., oil and/or gas, from the well and a pressure required at the wellhead to lift the fluids to the surface.

Parameters of the system affect the distribution described by the VLP. For example, parameters that affect how much pressure is required to lift fluids to the surface for a particular flow rate include friction inside the main tubing and each lateral, elevation changes, fluid properties, and fluid velocities. The loss of energy of fluid as it is guided up from the reservoir towards the wellhead can be described by a mechanical energy balance equation (Eq. 1) as $$\Delta P = p_{FBHP} - p_{surface} = \frac{g}{g_c}\rho\Delta z + \frac{\rho}{2g_c}\Delta u^2 + \frac{2f_f\rho u^2 L}{g_c D},$$

in which $p_{FBHP}$ is the flowing bottom hole pressure, $p_{surface}$ is the surface pressure, $g/g_c$ is a ratio of the gravitational constant to a gravitational conversion factor, $p\Delta z$ represents a hydrostatic pressure change due to an elevation difference between the reservoir and the wellhead, where $\rho$ is a fluid density and $\Delta z$ is a change in elevation. The second term, $$\frac{\rho}{2g_c}\Delta u^2$$

represents a kinetic energy change of the flowing fluid, in which $\Delta u$ is a change in fluid velocity, and $\rho\Delta u^2$ represents a change in kinetic energy per unit volume and $2g_c$ is a conversion factor to maintain unit consistency. The third term, $$\frac{2f_f\rho u^2 L}{g_c D}$$

represents a pressure drop due to frictional losses in the flow through the system from the reservoir to the wellhead. The term $f_f$ is a friction coefficient, L is a length of the multilateral well over which fluid flows, D is a diameter of a pipe of the multilateral well, and u is a velocity of the fluid.

The inflow reference depth is used as a reference point for determining the length (L) of the pipe, the elevation change between the reservoir, which is defined by the location of the inflow control valve closest to the wellhead, and the wellhead.

For a saturated reservoir, the common tubing experiences three-phase flow in which a pressure drop is highly dependent on gas density and velocity as fluid travels upward toward the wellhead and expands due to decreasing pressure. Many VLP correlations describe this phenomenon, each specializing in a certain fluid flow regime and/or flow inclination. In some implementations, analytical expressions that describe fluid flow and energy loss in a piping system under varying circumstances can be combined to provide an optimal analytical model that closely matches empirical evaluations.

Similar to calibrating the IPR, the system can implement one or more calibration methods to offset uncertainties in the analytics representation of the VLP relationship. For example, the VLP relationship can be fine-tuned to fit the three empirical measurements of the VLP curve. In other words, the system can determine a more accurate estimation of the VLP relationship by comparing the output of the analytical representation described above with the empirical evaluation of the VLP through pressure and flow rate measurements.

In some implementations, the system determines an operating point of the multilateral well as an intersection of the IPR plot and the VLP plot. The IPR plot illustrates the FBHP as a function of oil flow rate at the surface. The VLP plot illustrates the surface pressure as a function of oil flow rate at the surface. The intersection of the IPR and VLP plots provides a pressure-rate point that defines an optimal flow rate and pressure to operate the multilateral well. The operating point describes a flow rate and a pressure of the multilateral well under the conditions that determine the IPR and VLP relationships.

The system generates multiple sensitivity cases, in which each sensitivity case includes a distinct set of operational and environmental parameters. The parameters include one or more properties of the reservoir, one or more properties of the multiple fluids, and/or one or more properties of the multilateral well. In some cases, the parameters include a range of values of parameters including wellhead pressure, reservoir pressure, total liquid rate, water-cut percentage, and gas-oil-ratio. Each combination of the range of parameters generates a modified IPR and VLP relationship and operating point.

As described by the Vogel's equation, the IPR relationship depends on many factors including the geometry of the multilateral well, fluid properties, and reservoir properties. These parameters may vary from well to well, and even over the lifespan of a particular well, as fluid is extracted from the reservoir. By varying well parameters, reservoir parameters, and fluid properties, the system can simulate multiple IPR curves that mimic an evaluation of multiple wells or a single well at multiple points in time. Each sensitivity case simulates an operating scenario that is used to map real-time operating and environmental parameters, e.g., pressure measurements, of a multilateral well to a particular set of VLP and IPR curves to estimate associated flow rates based on the pressure measurements.

In some cases, a full operational range of each parameter that impacts an IPR and/or VLP relationship during the life of a particular oil field, reservoir, and or well, is used to generate multiple sensitivity cases. The varied parameters include static reservoir pressure, flowing wellhead pressure, gas-liquid-ratio, water-cut percentage, and total liquid rate. A relationship between operational and environmental parameters, fluid and reservoir pressures, and flow rates of various fluids from the reservoir, can be determined by scanning through ranges of the multiple parameters. However, the system is too complex to determine an analytical model, so numerical approaches are required to determine a pressure-rate relationship under a particular set of conditions.

For each sensitivity case, the system determines (306), based on the calibrated IPR relationship, the calibrated VLP relationship, and the sensitivity case, a simulated operating point. The simulated operating point is an intersection point of the simulated IPR relationship and the simulated VLP relationship. In other words, each sensitivity case is associated with a particular operating point.

Each sensitivity case defines a set of operational and environmental parameters that affect the flow rates, fluid dynamics, and pressures of the multilateral well. Therefore, each sensitivity case describes an operating condition of the multilateral well that produces fluids at a particular flow rate under particular pressures.

The system measures (308), during fluid production, a particular flowing bottom hole pressure, a particular surface pressure, and a particular reservoir pressure. The particular pressures are measured by respective pressure gauges as described in relation to FIGS. 2 and 5. During fluid production, the system does not include a portable fluid separator to measure fluid rates. However, the system can retrieve pressure measurements from the pressure gauges during fluid production.

The system predicts (310), based on an output of an optimizer, flow rates of one or more fluids, e.g., oil, gas, and water, that are produced by the multilateral well. The optimizer determines the flow rates based on an analysis of the sensitivity cases and the particular pressure measurements. The particular pressure measurements include pressure measurements from a bottom hole pressure gauge, surface pressure gauge, and a reservoir pressure gauge. In some implementations, inputs to the optimizer include a flowing wellhead pressure, a flowing bottomhole pressure, and an average reservoir pressure.

The optimizer considers a solution space defined by the sensitivity cases and determines a prediction of flow rates for each of the multiple fluids produced by the multilateral well based on the measured pressures. The optimizer iteratively searches the solution space and evaluates a minimization function at each pressure-rate point, in which the minimization function describes a difference between the measured pressures and the simulated pressures. The simulated pressures correspond to the analytical representation of the pressure drops that correspond to the lateral well segments and the common tubing segments, as described in relation to FIG. 5.

The optimization function can include optimization techniques like simulated annealing, genetic algorithm, particle swarm, and a trust-region method for nonlinear minimization. Each optimizer includes a starting value for each target parameter (e.g., flow rate, water-cut, gas-oil-ratio, etc.). The parameters are changed based on the particular optimization technique to converge on a solution of the minimization function that yields an error of less than a threshold value.

The system modifies (312), based on the one or more predicted flow rates, one or more properties of the multilateral well to optimize a respective fluid production rate. The modifications can aim to enhance well productivity, manage reservoir health, etc. For example, the modifications can include adjusting a choke valve to control the flow rate of fluids from the multilateral well to help manage the well's production rate to align with predicted optimal operating points. As another example, the modifications can include adding artificial lift to the well to increase flow rate from a well in which the natural reservoir pressure is insufficient. As another example, the modifications can include changing a size of one or more tubing elements to affect a velocity of the fluid and associated pressure losses due to friction.

Figure 4:
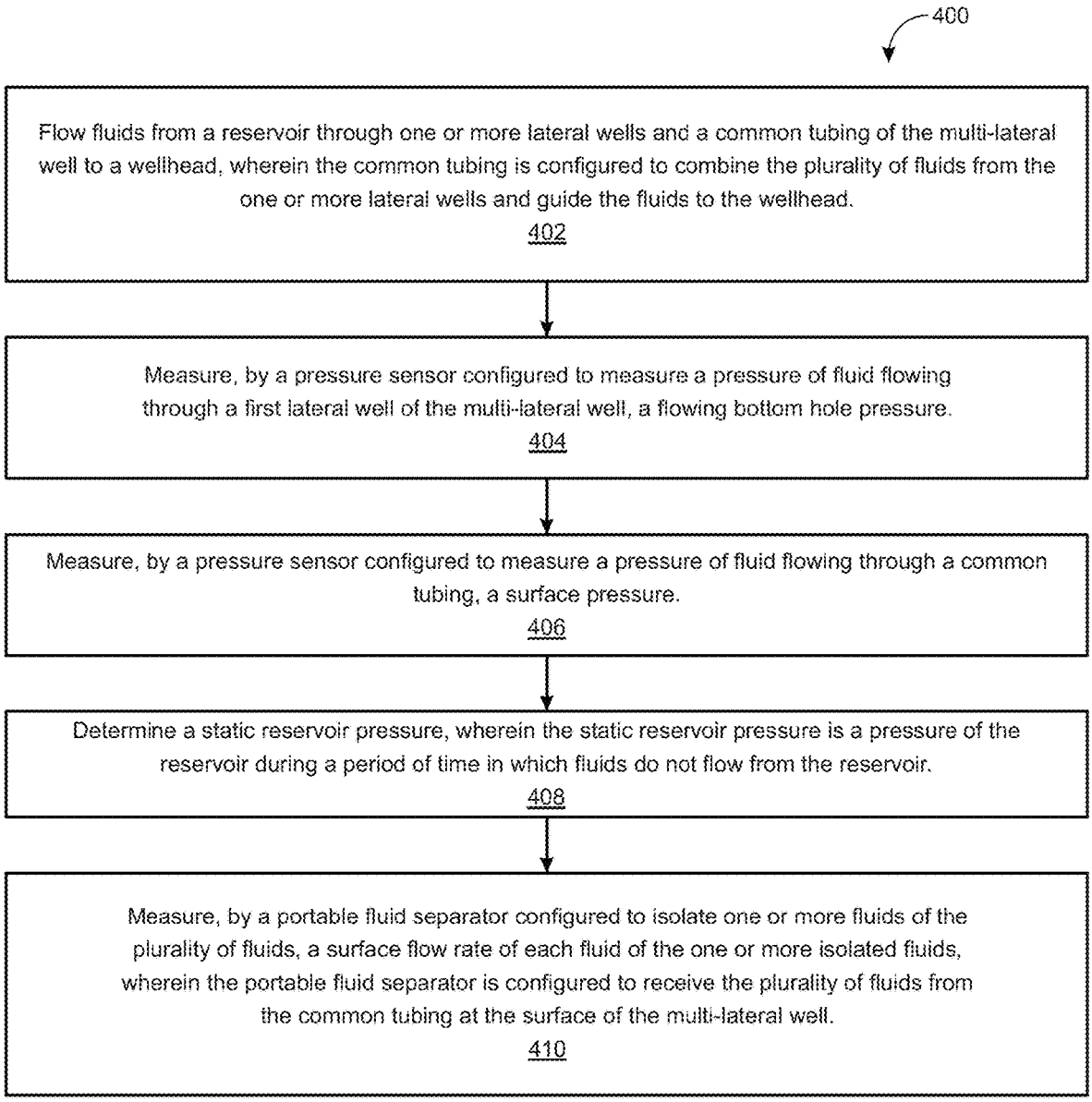
FIG. 4 is a flow diagram of an example process for determining pressure and flow rate data of a multilateral well at multiple choke valve settings.

FIG. 4 is a flow diagram of an example process 400 for determining pressure and flow rate data of a multilateral well at multiple choke valve settings. For clarity of presentation, the description that follows generally describes process 400 in the context of the other figures in this description. In some implementations, various steps of process 400 can be performed in parallel, in combination, in loops, or in any order.

The system flows (402) fluids from a reservoir through one or more lateral wells and a common tubing of the multilateral well to a wellhead, in which the common tubing is configured to combine the multiple fluids from the lateral wells and guide the fluids to the wellhead. The geometry and position of each component of the multilateral well is illustrated in relation to FIG. 2. In some cases, the fluids include oil, gas, and water.

The system measures (404), by a pressure gauge configured to measure a pressure of fluid flowing through a first lateral well of the multilateral well, a flowing bottom hole pressure.

The system measures (406), by a pressure gauge configured to measure a pressure of fluid flowing through a common tubing, a surface pressure.

The system determines (408) a static reservoir pressure, in which the static reservoir pressure is a pressure of the reservoir during a period of time in which fluids do not flow from the reservoir. In some cases, the static reservoir pressure is measured from the same well, or from a nearby well that access the same reservoir as the multilateral well.

The system measures (410), by a portable fluid separator configured to isolate one or more fluids of the multiple fluids, a surface flow rate of each fluid of the one or more isolated fluids, in which the portable fluid separator is configured to receive the fluids from the common tubing at the surface of the multilateral well.

Figure 5:
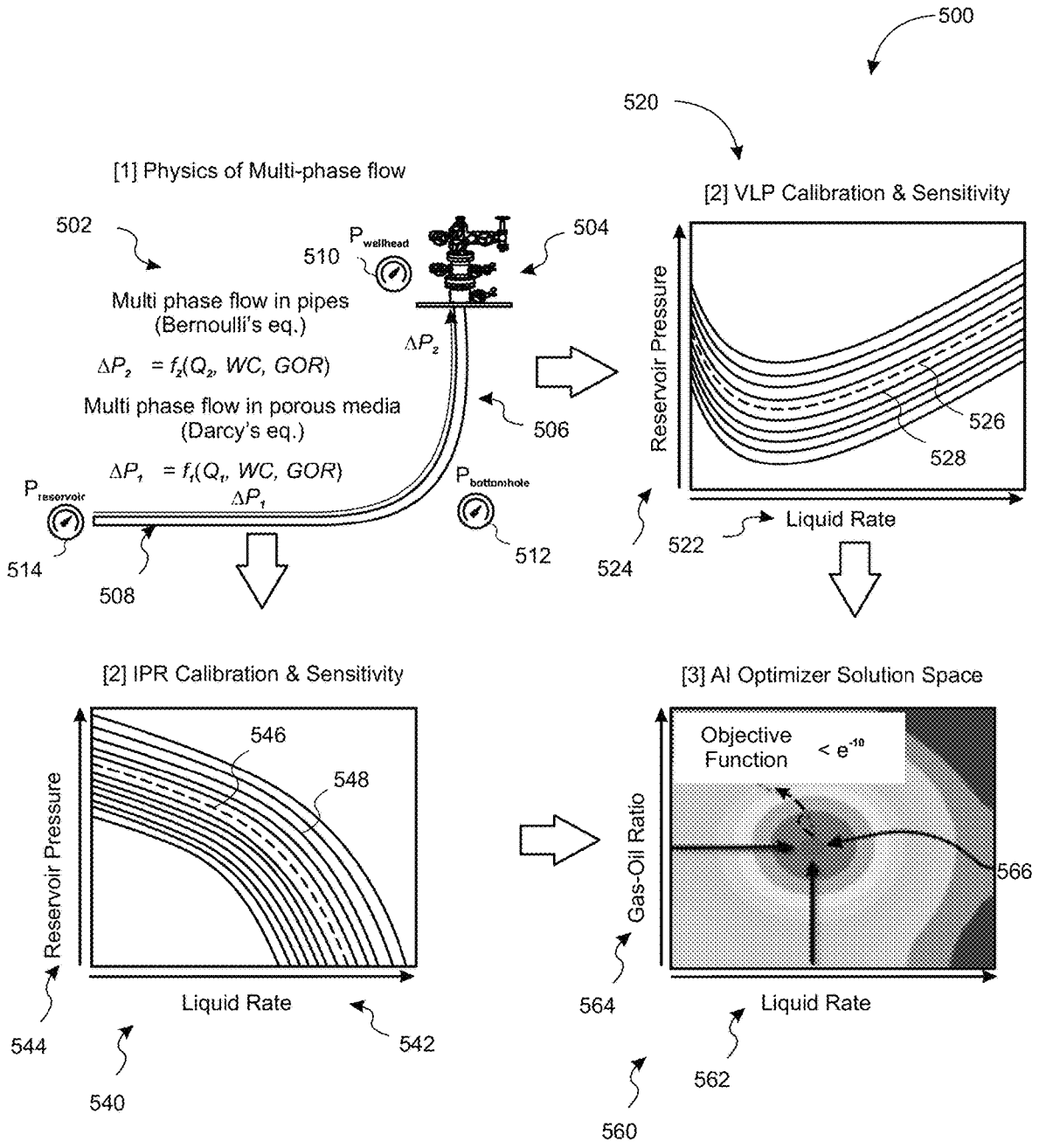
FIG. 5 is an illustration of example approach for determining an estimated flow rate of a multilateral well.

FIG. 5 is an illustration of example approach 500 for determining an estimated flow rate and gas-oil-ratio of a multilateral well 502. The example multilateral well 502 illustrates a multilateral well with a single lateral well. The approach 500 can be implemented on a multilateral well with multiple lateral wells. For clarity of presentation, the description that follows generally describes approach 500 in the context of the other figures in this description. The approach 500 includes actions implemented by a system that can include computing systems and components of the multilateral well 502.

The multilateral well 502 includes a surface-level wellhead 504, a common tubing 506, in which the common tubing 506 comingles fluid received by each lateral well, and a single lateral well 508. The multilateral well 502 includes three pressure gauges. A surface pressure gauge 510 is positioned at the wellhead 504 of the multilateral well 502. A bottom hole pressure gauge 512 is positioned at the bottom of the common tubing 506, before the beginning of the lateral wells, e.g., the lateral well 508. A reservoir pressure gauge 514 is positioned at the same location as the bottom hole pressure gauge 512, but is used to record the reservoir pressure when the well is static, e.g., not under production.

A pressure difference between the reservoir pressure gauge 514 and the bottom hole pressure gauge 512 can be represented by $$\Delta P_1 = p_{res} - p_{FBHP},$$

where $p_{res}$ is the reservoir pressure, as measured by the reservoir pressure gauge 514 and $p_{FBHP}$ is the flowing bottom hole pressure, as measured by the bottom hole pressure gauge 512. In some implementations, the flow of multiphase fluid from a porous reservoir, e.g., a fluid mixture of oil, gas, and water, from a reservoir into one of the lateral wells of a multilateral well, can be represented with an expression that considers fluid flow in a porous medium and multi-phase flow in general. Fluid flow rate in a porous medium can be represented as $$Q_l = -\frac{kA}{\mu B}\left(\frac{\Delta P_1}{\Delta L}\right),$$

where $Q_l$ is the volume of fluid that passes through a unit area per unit of time, k is the permeability of the porous medium, A is a cross-sectional area through which the fluid flows, μ is a dynamic viscosity of the fluid, B is a variable that denotes a formation volume factor which accounts for changes in volume from reservoir conditions to surface conditions, ΔP is a pressure drop between the reservoir pressure gauge 514 and the bottom hole pressure gauge 512, and ΔL is a length over which the pressure drop occurs.

Fluid flow rate for a multi-phase fluid can be represented by Darcy's equation as $$Q_l = -\frac{kA\Delta P_1}{\Delta L}\left(\frac{k_{ro}}{\mu_0 B_o} + \frac{k_{rw}}{\mu_W B_W} + \frac{k_{rg}}{\mu_g B_g}\right),$$

where $k_{r(o|W|g)}$ are the relative permeabilities for each phase through the porous medium, and a similar description for μ and B as described above relative to each fluid phase, e.g., oil, gas, and water. Combining the expressions for flow rate through a porous medium and flow rate for a multi-phase fluid and solving for a pressure drop between the reservoir pressure gauge 514 and the bottom hole pressure gauge 512, $\Delta P_1$, the pressure drop is a function of flow rate, water cut, e.g., a proportion of water in the fluid, and gas-oil-ratio, e.g., a ratio of gas to oil in the fluid. The expression for the pressure drop between the reservoir pressure gauge 514 and the bottom hole pressure gauge 512, which induces a natural inflow of fluid from the lateral well 508 into the wellbore, e.g., the common tubing 506, can be written as $$\Delta P_1 = f_1(Q_l, WC, GOR).$$

The flow of fluid through the lateral well 508 is described by the flow rate for multi-phase fluid and the flow rate through a porous medium. Although an exact expression for the flow rate of a multi-phase fluid through a porous medium involves multiple variable as described by Darcy's equation above, the expression is simplified to be written in terms of flow rate ($Q_l$) and the pressure drop ($\Delta P_1$) as related through the function $f_1$.

Similar to the calculation of the pressure drop between the reservoir pressure gauge 514 and the bottom hole pressure gauge 512, a pressure drop between the bottom hole pressure gauge 512 and the surface pressure gauge 510 can be written as $$\Delta P_2 = p_{FBHP} - p_{surface},$$

where $p_{FBHP}$ is the flowing bottom hole pressure as measured by the bottom hole pressure gauge 512 and $p_{surface}$ is a pressure surface as measured at the wellhead 504 by the surface pressure gauge 510. A pressure difference in a vertical pipe is described by Eq. 1 as described in relation to FIG. 3. A pressure difference in a vertical pipe flowing a multi-phase fluid can be expressed as $$\Delta P_2 = \frac{g}{g_c}\rho\Delta z + \frac{\bar{\rho}}{2g_c}\Delta\bar{u}^2 + \frac{2f_f\bar{\rho}\bar{u}^2 L}{g_c D},$$

where the velocity and fluid density are modeled as an average velocity and fluid density across each fluid of the multi-phase fluid.

Given the relationship between the pressure drop between the reservoir pressure gauge 514 and the bottom hole pressure gauge 512 and fluid velocity (e.g., which is related to flow rate), and fluid density, the pressure drop can be expressed as a function, e.g., it depends on, a fluid flow rate, water cut, and gas-oil-ratio, and can be expressed similar to $\Delta P_1$ as $$\Delta P_2 = f_2(Q_l, WC, GOR).$$

The pressure differences $\Delta P_1$ and $\Delta P_2$ depend on the total liquid flowrate, the water-cut percentage ("WC"), and the gas-oil-ratio ("GOR") of the multi-phase fluid flowing through the lateral well 508 and the common tubing 506 to the wellhead 504. However, the relationship is complex and depends on many variables and approximate analytical representations. However, by measuring the respective pressures with the reservoir pressure gauge 514, the bottom hole pressure gauge 512, and the surface pressure gauge 510, a correlation between the measured pressure differences during fluid extraction and the GOR and WC of the fluid can be determined numerically.

The pressure difference $\Delta P_1$ which describes a pressure difference between two approximately horizontal points of a lateral well represents an ability of a well to efficiently retrieve and move fluids from the reservoir to the common tubing 506. The ability of the well to move fluids from the reservoir to the common tubing 506 can be characterized by the IPR curve. The pressure difference $\Delta P_2$ which describes a pressure difference between two approximately vertical points of the common tubing 506 represents an ability of a well to efficiently move the fluids from the bottom of the well up to the wellhead 504. The ability of the well to move fluids from the bottom of the well to the wellhead 504 can be characterized by the VLP curve.

A plot 540 illustrates a calibrated simulated IPR curve with multiple sensitivity cases, as described in relation to FIG. 3. The calibrated IPR curve 546 along with multiple sensitivity cases, e.g., sensitivity case 548, illustrate a relationship between a liquid rate 542 at the wellhead 504 and a reservoir pressure 544, as determined by a modeled reservoir pressure gauge, modeled to be configured as the reservoir pressure gauge 514.

The plot 540 represents a scenario in which the reservoir pressure 544 is simulated as a function of flow rate and calibrated with measured data. The measured data includes pressure measurements as a function of the flow rate as controlled by a choke valve, in which the choke valve is a component of the wellhead 504 and the flow rate is determined by a portable fluid separator that is configured to receive the fluids from the choke valve. The calibrated pressure-rate curve 546 illustrates a relationship between the fluid flow rate, e.g., liquid rate 542 and the reservoir pressure 544 in which for low or zero fluid flow, the reservoir pressure 544 exhibits a static reservoir pressure. As the liquid rate 542 increases, the reservoir pressure 544 drops at a first rate to a flowing bottom hole pressure, and as the liquid rate 542 continues to increase, the reservoir pressure 544 drops at a second rate to a lower flowing bottom hole pressure. As illustrated in the pot 540, the pressure-rate relationship shifts, e.g., the sensitivity case 546, depending on a particular sensitivity case, as the associated IPR depends on multiple parameters that are different between each sensitivity case.

A plot 520 illustrates a calibrated simulated pressure-rate curve with multiple sensitivity cases, in which the VLP relationship is varied, as described in relation to FIG. 4. The calibrated pressure-rate curve 526 along with multiple sensitivity cases, e.g., sensitivity case 528, illustrate a relationship between a liquid rate 522 at the wellhead 504 and a reservoir pressure 524, as determined by a modeled reservoir pressure gauge, modeled to be configured as the reservoir pressure gauge 514.

The plot 520 represents a scenario in which the reservoir pressure 544 is simulated as a function of flow rate and calibrated with measured data. The measured data includes pressure measurements as a function of the flow rate as controlled by a choke valve, in which the choke valve is a component of the wellhead 504 and the flow rate is determined by a portable fluid separator that is configured to receive the fluids from the choke valve. The calibrated pressure-rate curve 526 illustrates a relationship between the fluid flow rate, e.g., liquid rate 522 and the reservoir pressure 524 in which for low or zero fluid flow, the reservoir pressure 524 exhibits a static reservoir pressure. As the liquid rate 522 increases, the reservoir pressure 524 drops to a minimum point and then increases as the liquid rate 522 continues to increase. As illustrated in the plot 520, the pressure-rate relationship shifts, e.g., the sensitivity case 526, depending on a particular sensitivity case, as the associated VLP depends on multiple parameters that are different between each sensitivity case.

The plots 520 and 540 represent two different performance metrics associated with different sections of the multilateral well. The plot 520 represents a pressure-rate relationship from the common tubing 506 to the wellhead 504. The plot 540 represents a pressure-rate relationship from the reservoir to the lateral well 508. In other words, a nodal analysis of the multilateral well models a relationship between pressure and flow rate using different physical models, which results in different pressure-rate relationships as illustrated by plots 520 and 540.

The pressure difference $\Delta P_1$ as measured between the reservoir pressure gauge 514 and bottom hole pressure gauge 512 is related to the surface flow rate by relationships defined by the structure and environment of the lateral well 508. The efficiency of extracting fluid from the reservoir to the lateral well 508 is described by the example IPR curve for multiple sensitivity cases in plot 540. Similarly, the pressure difference $\Delta P_2$ as measured between the bottom hole pressure gauge 512 and the surface pressure gauge 510 is related to the surface flow rate by relationships defined by the structure and environment of the common tubing 506. The efficiency of guiding the fluid from the bottom of the well to the wellhead 504 is described by the example VLP curve 520.

To determine a flow rate of the fluids guided from the reservoir to the wellhead by the lateral well 508 and the common tubing 506 for a set of arbitrary pressure measurements, the system determines a difference between arbitrary pressure measurements and simulated pressure measurements, in which the simulated pressure measurements are determined by the sensitivity cases. For example, the system minimizes the following expression, $$\min\left\{\left(\begin{matrix}\Delta P_1^* - f_1(Q_l, WC, GOR)^2 \\ \Delta P_2^* - f_2(Q_l, WC, GOR)^2\end{matrix}\right)\right\},$$

in which the simulated pressure drops $f_1$ and $f_2$ are evaluated for multiple values of WC, flow rate ($Q_l$), and GOR to find a solution that minimizes the difference between the simulated pressure drops and the measured pressure drops $\Delta P^*_1$ and $\Delta P^*_2$. In some implementations, the system determines a threshold value, e.g., $e^{-10}$, such that if values of $Q_l$, WC, and GOR are found such that the minimization function is less than the threshold value, the corresponding values are considered to be a solution, and therefore the estimated values of flow rate, water cut percentage, and GOR associated with the measured pressure values.

Techniques for determining values of $Q_l$, WC, and GOR that satisfy the minimization function include optimization techniques like simulated annealing, genetic algorithm, particle swarm, and a trust-region method for nonlinear minimization. Each optimizer includes a starting value for each parameter $Q_l$, WC, and GOR. The parameters are changed based on the particular optimization technique to converge on a solution of the minimization function that yields an error of less than the threshold value.

Each optimization technique involves search a solution space defined by the sensitivity cases to find a set of parameters (e.g., flow rates) that correlate with the measured pressure values. The techniques interpolate between the sensitivity cases to determine a precise estimation of the predicted flow rates.

Figure 6:
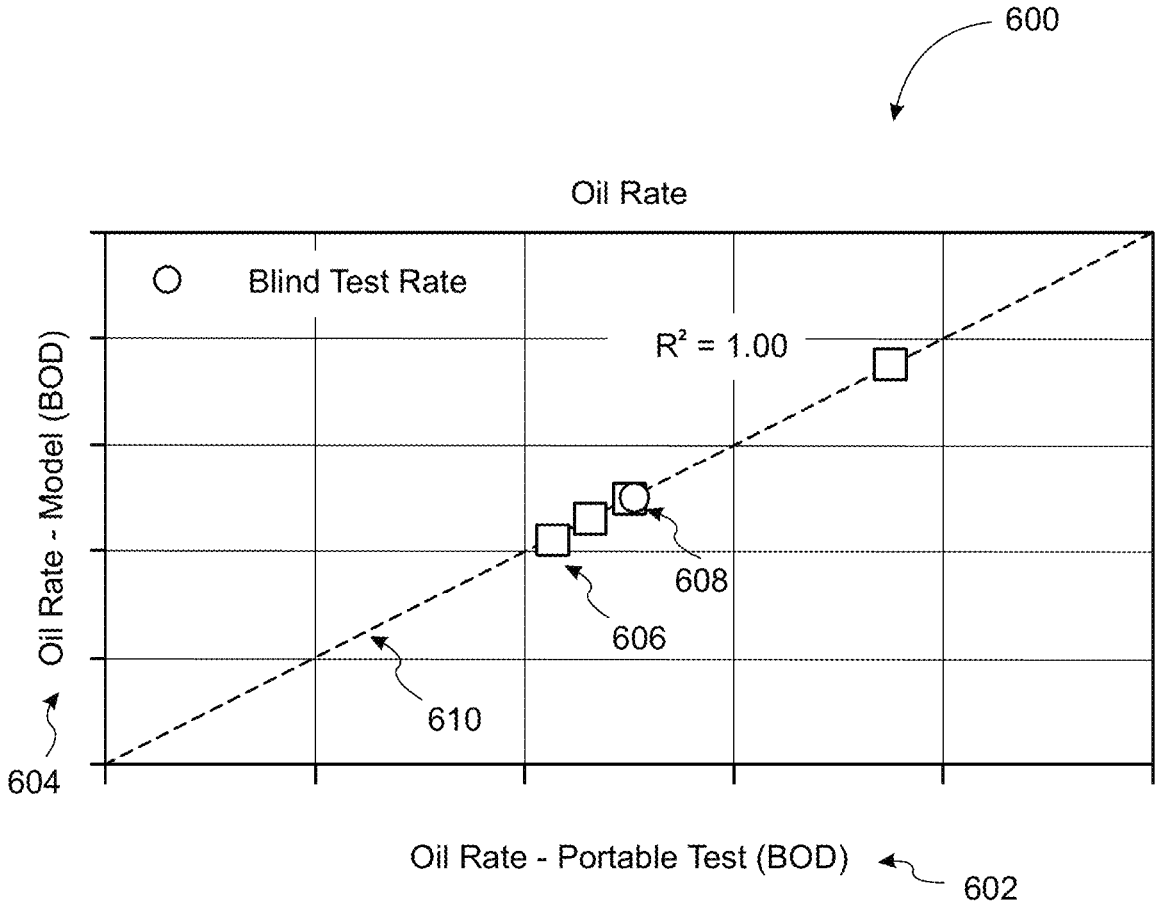
FIG. 6 is a plot that illustrates an example relationship between a measured flow rate and a predicted flow rate.

FIG. 6 is a plot 600 that illustrates an example relationship between a measured flow rate and a predicted flow rate. The plot 600 compares a first oil rate 602 measured by a portable fluid separator with a second oil rate 604 estimated by a process similar to the process 300 and a process that implements the approach 500. The plot 600 includes multiple measured-estimated data points, e.g., data point 606. The plot 600 also includes a blind test data point 608 in which only pressure data is processed by an optimizer to estimate a flow rate. The blind test data includes input pressure values that are not used in determining $f_1$ and $f_2$, as described in relation to FIG. 5. The plot 600 includes a unit slope line 610 that demonstrates a correlation with a correlation parameter of 1.

Figure 7:
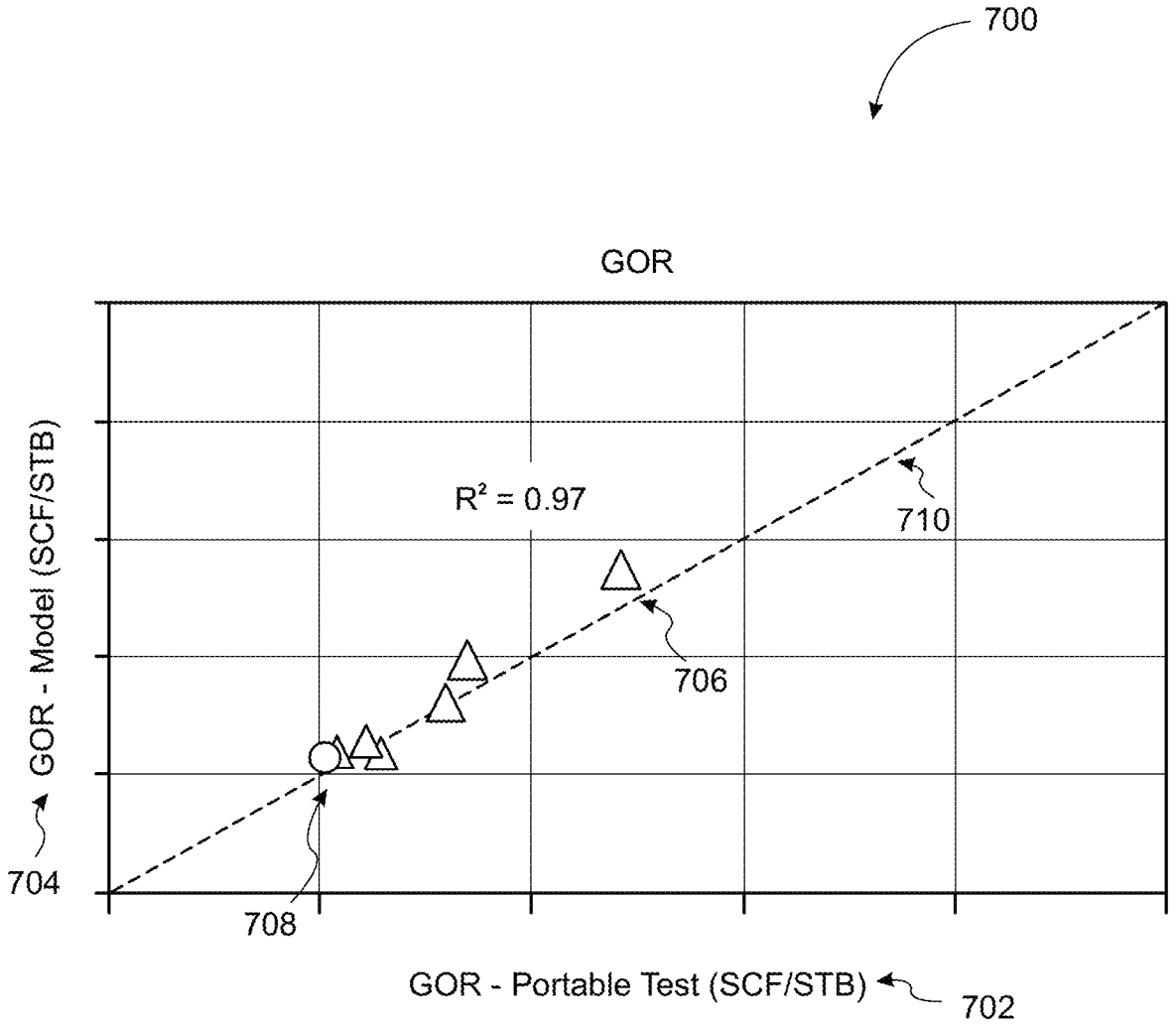
FIG. 7 is a plot that illustrates a relationship between a measured gas-oil-ratio and a predicted gas-oil-ratio.

FIG. 7 is a plot 700 that illustrates an example relationship between a measured gas-oil-ratio and a predicted gas-oil-ratio. The plot 700 compares a first gas-oil-ratio 702 evaluated by a portable fluid separator with a second gas-oil-ratio 704 estimated by a process similar to the process 300 and a process that implements the approach 500. The plot 700 includes multiple measured-estimated data points, e.g., data point 706. The plot 700 also includes a blind test data point 708 in which only pressure data is processed by an optimizer to estimate a gas-oil-ratio. The blind test data includes input pressure values that are not used in determining $f_1$ and $f_2$, as described in relation to FIG. 5. The plot 700 includes a unit slope line 710 that demonstrates a correlation with a correlation parameter of 0.97.

Figure 8:
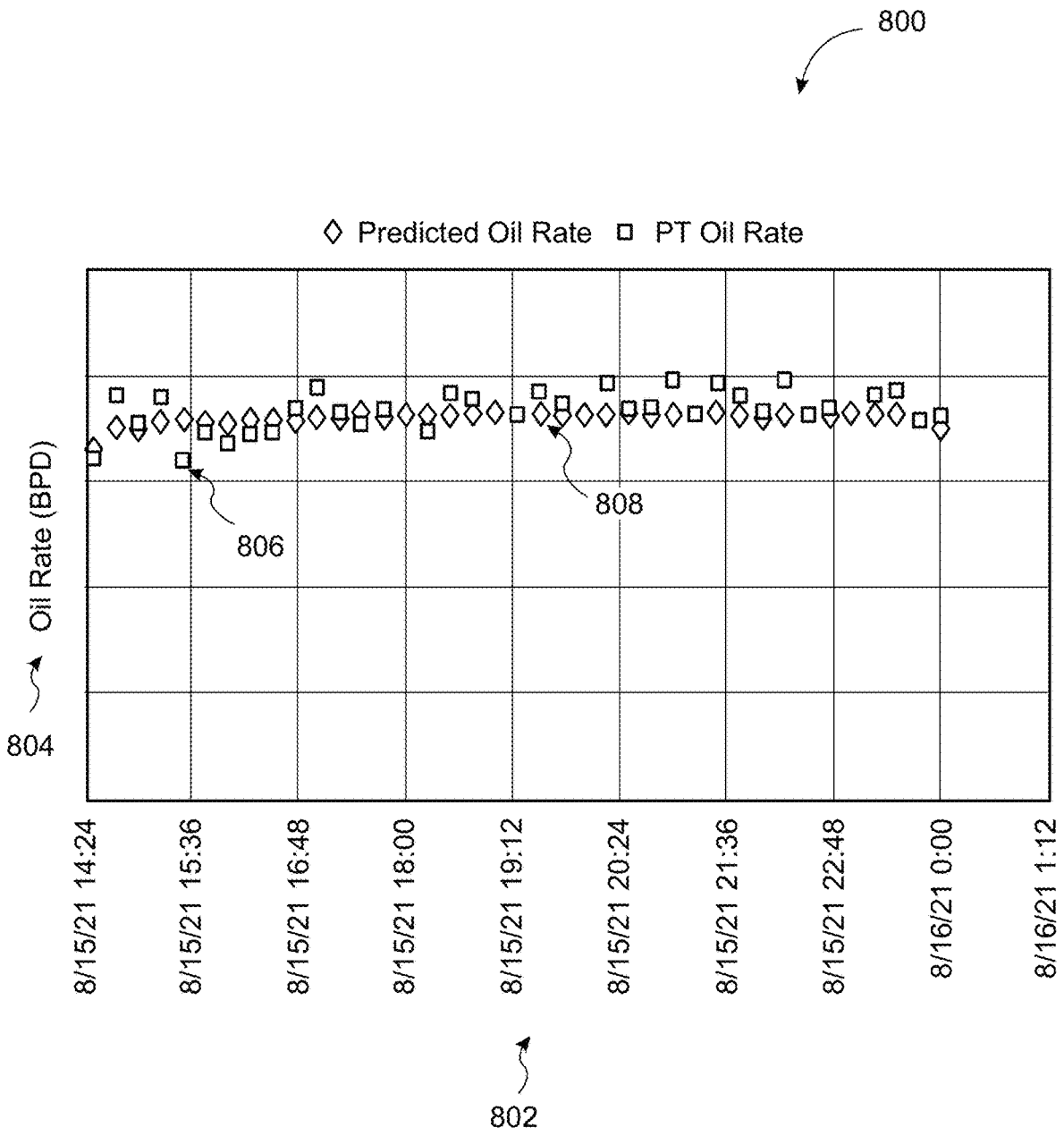
FIG. 8 is a plot that illustrates a comparison of a measured flow rate and a predicted flow rate at multiple times.

FIG. 8 is a plot 800 that illustrates an example comparison of a measured flow rate and a predicted flow rate at multiple times. The data illustrated in plot 800 include a measured oil rate, e.g., data point 806, and a predicted oil rate, e.g., data point 808, at multiple time points. The horizontal axis 802 illustrates a range of time points over which an oil flow rate 804 is measured by a portable rate separator to determine the measured oil rate and a predicted oil rate, as predicted by an optimizer by processing a surface pressure and a flowing hole bottom pressure.

Figure 9:
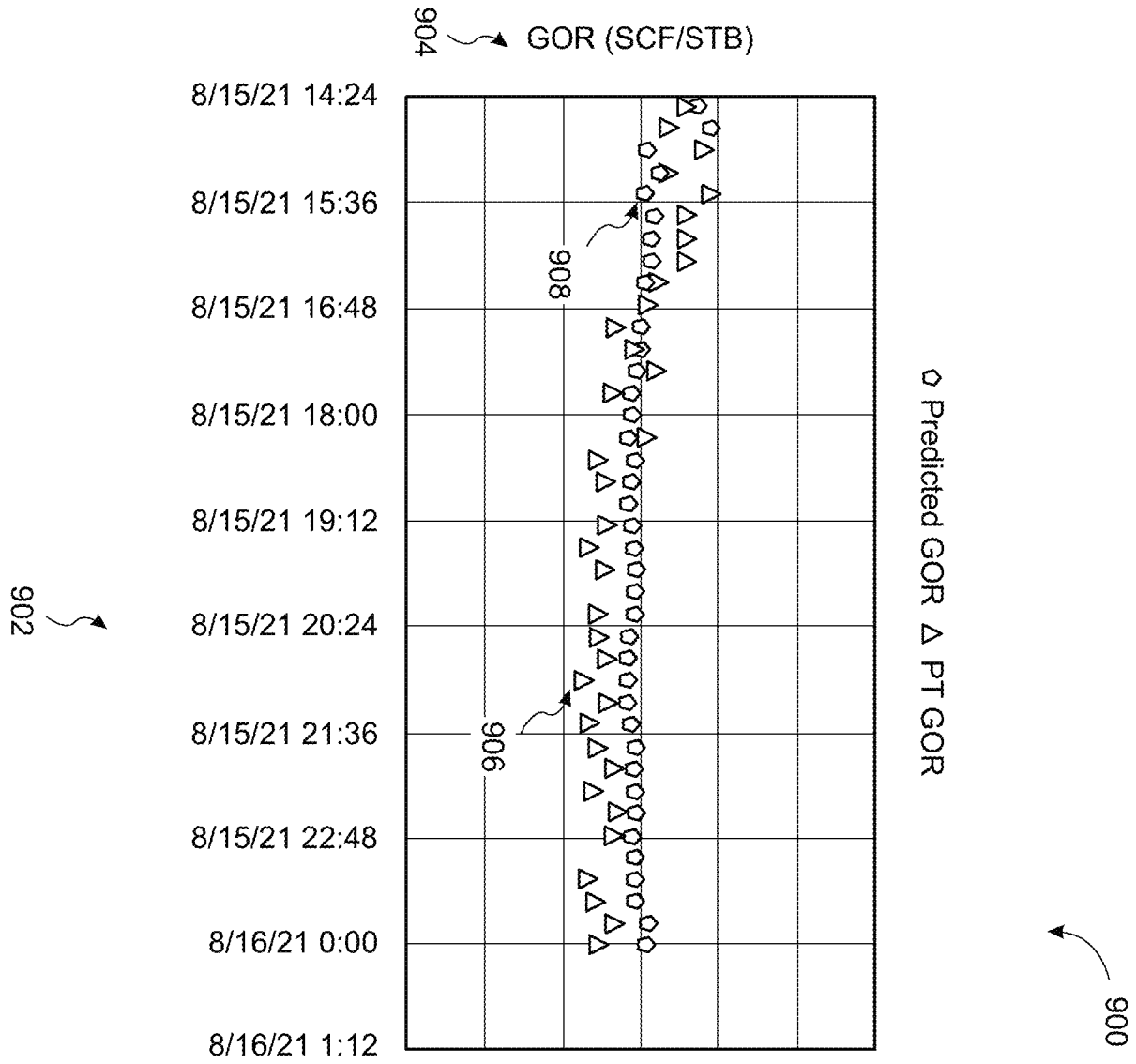
FIG. 9 is a plot that illustrates a comparison of a measured gas-oil-ratio and a predicted gas-oil-ratio at multiple times.

FIG. 9 is a plot 900 that illustrates an example comparison of a measured gas-oil-ratio and a predicted gas-oil-ratio at multiple times. The data illustrated in plot 900 include a measured gas-oil-ratio, e.g., data point 906, and a predicted gas-oil-ratio, e.g., data point 908, at multiple time points. The horizontal axis 902 illustrates a range of time points over which a gas-oil-ratio 904 is measured by a portable rate separator to determine the measured gas-oil-ratio and a predicted gas-oil-ratio, as predicted by an optimizer by processing a surface pressure and a flowing hole bottom pressure.

Figure 10:
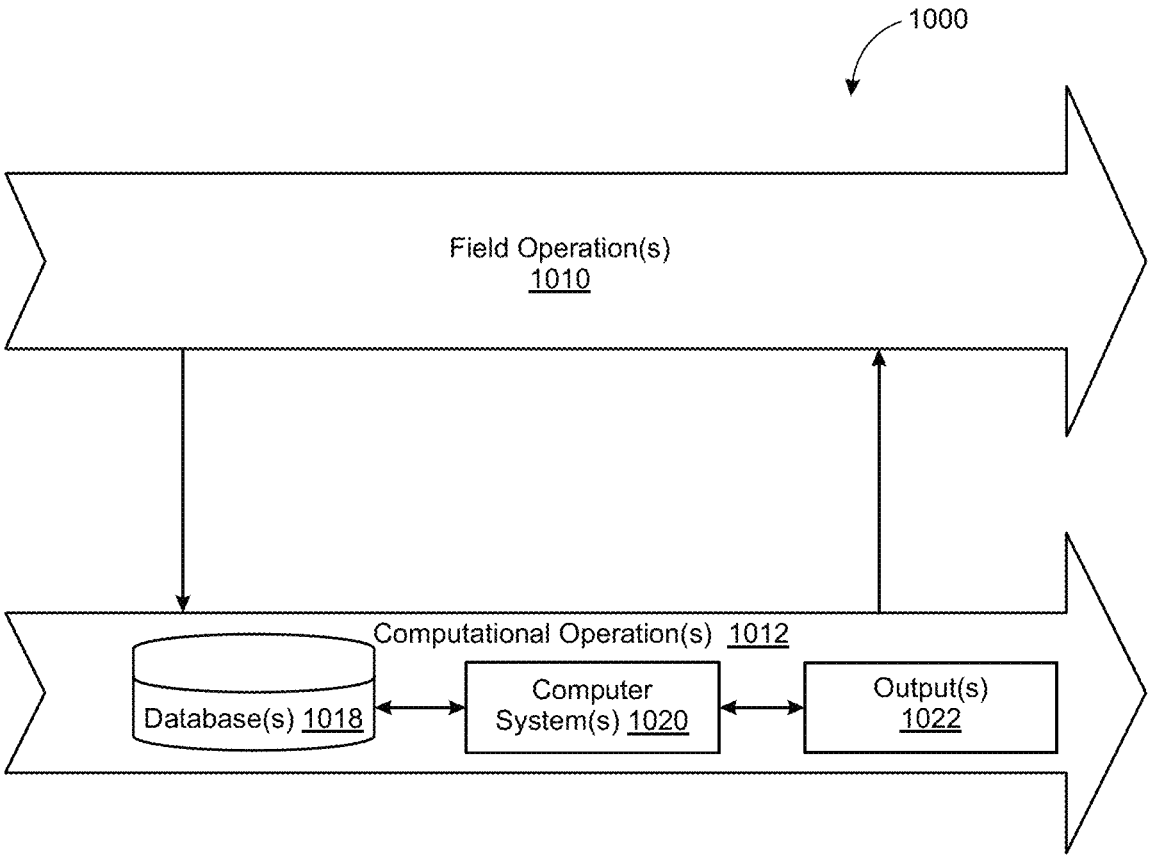
FIG. 10 is a schematic illustrating field operations to produce hydrocarbons.

FIG. 10 illustrates hydrocarbon production operations 1000 that include both one or more field operations 1010 and one or more computational operations 1012, which exchange information and control exploration to produce hydrocarbons. In some implementations, outputs of techniques of the present disclosure (e.g., the method 200) can be performed before, during, or in combination with the hydrocarbon production operations 1000, specifically, for example, either as field operations 1010 or computational operations 1012, or both. For example, the process 200 collect data during field operations, processes the data in computational operations, and can determine locations to perform additional field operations.

Examples of field operations 1010 include forming/drilling a wellbore, hydraulic fracturing, producing through the wellbore, injecting fluids (such as water) through the wellbore, to name a few. In some implementations, methods of the present disclosure can trigger or control the field operations 1010. For example, the methods of the present disclosure can generate data from hardware/software including sensors and physical data gathering equipment (e.g., seismic sensors, well logging tools, flow meters, and temperature and pressure gauges). The methods of the present disclosure can include transmitting the data from the hardware/software to the field operations 1010 and responsively triggering the field operations 1010 including, for example, generating plans and signals that provide feedback to and control physical components of the field operations 1010. Alternatively, or in addition, the field operations 1010 can trigger the methods of the present disclosure. For example, implementing physical components (including, for example, hardware, such as sensors) deployed in the field operations 1010 can generate plans and signals that can be provided as input or feedback (or both) to the methods of the present disclosure.

Examples of computational operations 1012 include one or more computer systems 1020 that include one or more processors and computer-readable media (e.g., non-transitory computer-readable media) operatively coupled to the one or more processors to execute computer operations to perform the methods of the present disclosure. The computational operations 1012 can be implemented using one or more databases 1018, which store data received from the field operations 1010 and/or generated internally within the computational operations 1012 (e.g., by implementing the methods of the present disclosure) or both. For example, the one or more computer systems 1020 process inputs from the field operations 1010 to assess conditions in the physical world, the outputs of which are stored in the databases 1018. For example, seismic sensors of the field operations 1010 can be used to perform a seismic survey to map subterranean features, such as facies and faults. In performing a seismic survey, seismic sources (e.g., seismic vibrators or explosions) generate seismic waves that propagate in the earth and seismic receivers (e.g., geophones) measure reflections generated as the seismic waves interact with boundaries between layers of a subsurface formation. The source and received signals are provided to the computational operations 1012 where they are stored in the databases 1018 and analyzed by the one or more computer systems 1020.

In some implementations, one or more outputs 1022 generated by the one or more computer systems 1020 can be provided as feedback/input to the field operations 1010 (either as direct input or stored in the databases 1018). The field operations 1010 can use the feedback/input to control physical components used to perform the field operations 1010 in the real world.

For example, the computational operations 1012 can process the seismic data to generate three-dimensional (3D) maps of the subsurface formation. The computational operations 1012 can use these 3D maps to provide plans for locating and drilling exploratory wells. In some operations, the exploratory wells are drilled using logging-while-drilling (LWD) techniques which incorporate logging tools into the drill string. LWD techniques can enable the computational operations 1012 to process new information about the formation and control the drilling to adjust to the observed conditions in real-time.

The one or more computer systems 1020 can update the 3D maps of the subsurface formation as information from one exploration well is received and the computational operations 1012 can adjust the location of the next exploration well based on the updated 3D maps. Similarly, the data received from production operations can be used by the computational operations 1012 to control components of the production operations. For example, production well and pipeline data can be analyzed to predict slugging in pipelines leading to a refinery and the computational operations 1012 can control machine operated valves upstream of the refinery to reduce the likelihood of plant disruptions that run the risk of taking the plant offline.

In some implementations of the computational operations 1012, customized user interfaces can present intermediate or final results of the above-described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or app), or at a central processing facility.

The presented information can include feedback, such as changes in parameters or processing inputs, that the user can select to improve a production environment, such as in the exploration, production, and/or testing of petrochemical processes or facilities. For example, the feedback can include parameters that, when selected by the user, can cause a change to, or an improvement in, drilling parameters (including drill bit speed and direction) or overall production of a gas or oil well. The feedback, when implemented by the user, can improve the speed and accuracy of calculations, streamline processes, improve models, and solve problems related to efficiency, performance, safety, reliability, costs, downtime, and the need for human interaction.

In some implementations, the feedback can be implemented in real-time, such as to provide an immediate or near-immediate change in operations or in a model. The term real-time (or similar terms as understood by one of ordinary skill in the art) means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second(s), or less than 10 s. While the requested data need not be displayed (or initiated for display) instantaneously, it is displayed (or initiated for display) without any intentional delay, accounting for processing limitations of a described computing system and time required to, for example, gather, accurately measure, analyze, process, store, or transmit the data.

Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart or are in different countries or other jurisdictions.

Figure 11:
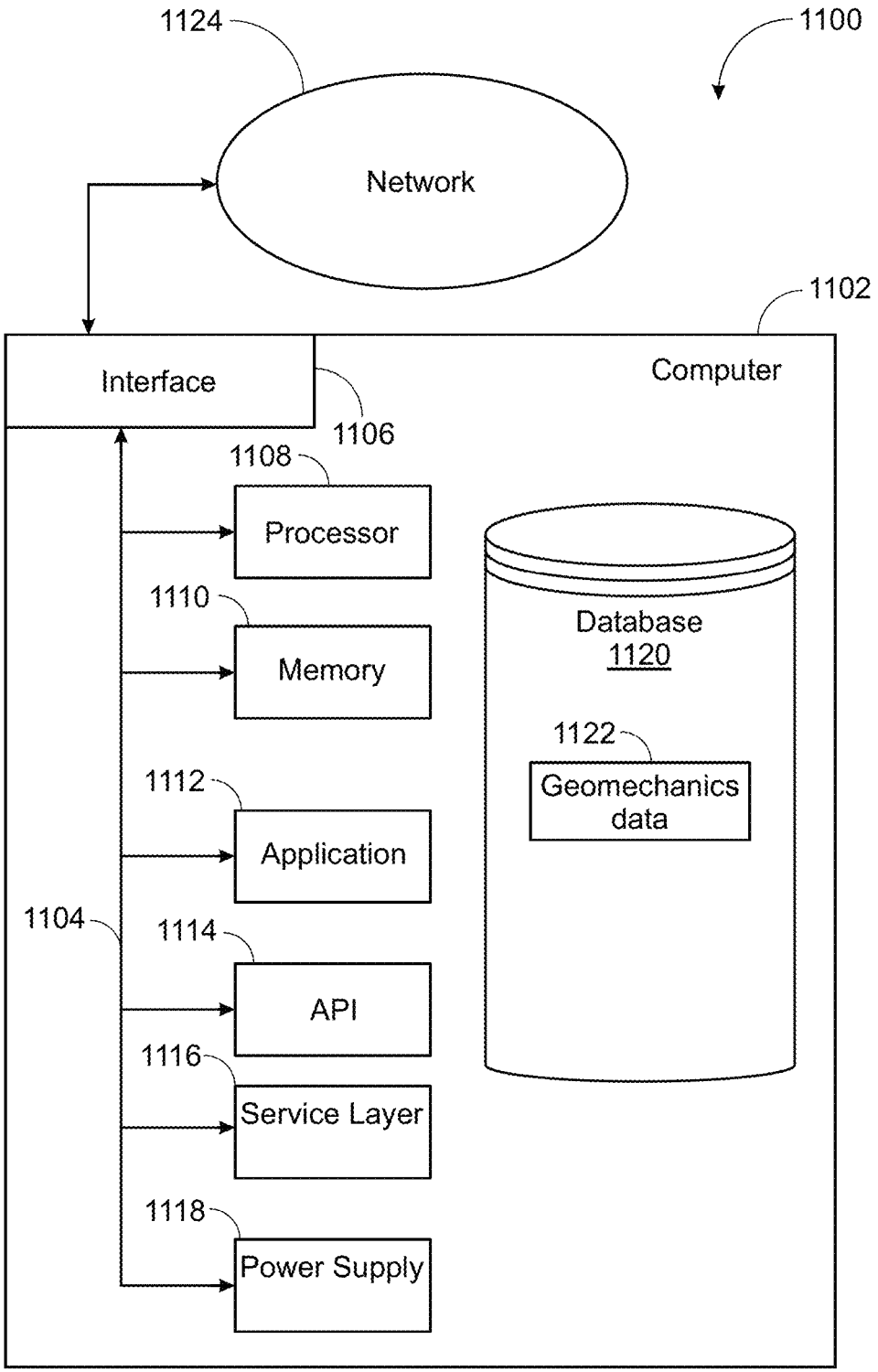
FIG. 11 is a diagram of an example computing system.

FIG. 11 is a block diagram of an example computer system 1100 used to provide computational functionalities associated with described algorithms, methods, functions, processes, flows, and procedures described in the present disclosure, according to some implementations of the present disclosure. The illustrated computer 1102 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 1102 can include input devices such as keypads, keyboards, and touch screens that can accept user information. Also, the computer 1102 can include output devices that can convey information associated with the operation of the computer 1102. The information can include digital data, visual data, audio information, or a combination of information. The information can be presented in a graphical user interface (UI) (or GUI).

The computer 1102 can serve in a role as a client, a network component, a server, a database, a persistency, or components of a computer system for performing the subject matter described in the present disclosure. The illustrated computer 1102 is communicably coupled with a network 1124. In some implementations, one or more components of the computer 1102 can be configured to operate within different environments, including cloud-computing-based environments, local environments, global environments, and combinations of environments.

At a high level, the computer 1102 is an electronic computing device operable to receive, transmit, process, store, and manage data and information associated with the described subject matter. According to some implementations, the computer 1102 can also include, or be communicably coupled with, an application server, an email server, a web server, a caching server, a streaming data server, or a combination of servers.

The computer 1102 can receive requests over network 1124 from a client application (for example, executing on another computer 1102). The computer 1102 can respond to the received requests by processing the received requests using software applications. Requests can also be sent to the computer 1102 from internal users (for example, from a command console), external (or third) parties, automated applications, entities, individuals, systems, and computers.

Each of the components of the computer 1102 can communicate using a system bus 1104. In some implementations, any or all of the components of the computer 1102, including hardware or software components, can interface with each other or the interface 1106 (or a combination of both), over the system bus 1104. Interfaces can use an application programming interface (API) 1114, a service layer 1116, or a combination of the API 1114 and service layer 1116. The API 1114 can include specifications for routines, data structures, and object classes. The API 1114 can be either computer-language independent or dependent. The API 1114 can refer to a complete interface, a single function, or a set of APIs.

The service layer 1116 can provide software services to the computer 1102 and other components (whether illustrated or not) that are communicably coupled to the computer 1102. The functionality of the computer 1102 can be accessible for all service consumers using this service layer. Software services, such as those provided by the service layer 1116, can provide reusable, defined functionalities through a defined interface. For example, the interface can be software written in JAVA, C++, or a language providing data in extensible markup language (XML) format. While illustrated as an integrated component of the computer 1102, in alternative implementations, the API 1114 or the service layer 1116 can be stand-alone components in relation to other components of the computer 1102 and other components communicably coupled to the computer 1102. Moreover, any or all parts of the API 1114 or the service layer 1116 can be implemented as child or sub-modules of another software module, enterprise application, or hardware module without departing from the scope of the present disclosure.

The computer 1102 includes an interface 1106. Although illustrated as a single interface 1106 in FIG. 11, two or more interfaces 1106 can be used according to implementations of the computer 1102 and the described functionality. The interface 1106 can be used by the computer 1102 for communicating with other systems that are connected to the network 1124 (whether illustrated or not) in a distributed environment. Generally, the interface 1106 can include, or be implemented using, logic encoded in software or hardware (or a combination of software and hardware) operable to communicate with the network 1124. More specifically, the interface 1106 can include software supporting one or more communication protocols associated with communications. As such, the network 1124 or the interface's hardware can be operable to communicate physical signals within and outside of the illustrated computer 1102.

The computer 1102 includes a processor 1108. Although illustrated as a single processor 1108 in FIG. 11, two or more processors 1108 can be used according to implementations of the computer 1102 and the described functionality. Generally, the processor 1108 can execute instructions and can manipulate data to perform the operations of the computer 1102, including operations using algorithms, methods, functions, processes, flows, and procedures as described in the present disclosure.

The computer 1102 also includes a database 1120 that can hold data (such geomechanics data 1122) for the computer 1102 and other components connected to the network 1124 (whether illustrated or not). For example, database 1120 can be in-memory or a database storing data consistent with the present disclosure. In some implementations, database 1120 can be a combination of two or more different database types (for example, hybrid in-memory and conventional databases) according to implementations of the computer 1102 and the described functionality. Although illustrated as a single database 1120 in FIG. 11, two or more databases (of the same, different, or combination of types) can be used according to implementations of the computer 1102 and the described functionality. While database 1120 is illustrated as an internal component of the computer 1102, in alternative implementations, database 1120 can be external to the computer 1102.

The computer 1102 also includes a memory 1110 that can hold data for the computer 1102 or a combination of components connected to the network 1124 (whether illustrated or not). Memory 1110 can store any data consistent with the present disclosure. In some implementations, memory 1110 can be a combination of two or more different types of memory (for example, a combination of semiconductor and magnetic storage) according to implementations of the computer 1102 and the described functionality. Although illustrated as a single memory 1110 in FIG. 11, two or more memories 1110 (of the same, different, or combination of types) can be used according to implementations of the computer 1102 and the described functionality. While memory 1110 is illustrated as an internal component of the computer 1102, in alternative implementations, memory 1110 can be external to the computer 1102.

The application 1112 can be an algorithmic software engine providing functionality according to implementations of the computer 1102 and the described functionality. For example, application 1112 can serve as one or more components, modules, or applications. Further, although illustrated as a single application 1112, the application 1112 can be implemented as multiple applications 1118 on the computer 1102. In addition, although illustrated as internal to the computer 1102, in alternative implementations, the application 1112 can be external to the computer 1102.

The computer 1102 can also include a power supply 1118. The power supply 1118 can include a rechargeable or non-rechargeable battery that can be configured to be either user- or non-user-replaceable. In some implementations, the power supply 1118 can include power-conversion and management circuits, including recharging, standby, and power management functionalities. In some implementations, the power-supply 1118 can include a power plug to allow the computer 1102 to be plugged into a wall socket or a power source to, for example, power the computer 1102 or recharge a rechargeable battery.

There can be any number of computers 1102 associated with, or external to, a computer system including the computer 1102, with each computer 1102 communicating over network 1124. Further, the terms "client," "user," and other appropriate terminology can be used interchangeably, as appropriate, without departing from the scope of the present disclosure. Moreover, the present disclosure contemplates that many users can use one computer 1102 and one user can use multiple computers 1102.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random-access memory (RAM), read only memory (ROM), phase change memory (PRAM), static random-access memory (SRAM), dynamic random-access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks.

While this specification contains many specific implementation details, these should not be construed as limitations on the scope of what may be claimed, but rather as descriptions of features that may be specific to implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Several implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and the described program components and systems can generally be integrated together in a single software product or packaged into multiple software products.

Accordingly, the previously described example implementations do not define or constrain the present disclosure.

Other changes, substitutions, and alterations are also possible without departing from the spirit and scope of the present disclosure.

Furthermore, any claimed implementation is applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

Several embodiments of these systems and methods have been described. Nevertheless, it will be understood that various modifications may be made without departing from the spirit and scope of this disclosure. Accordingly, other embodiments are within the scope of the following claims.

Examples

In some implementations, methods for determining fluid production rates in a high gas-oil-ratio environment from a multilateral well include receiving pressure and flow rate data from the multilateral well. The data is received at multiple choke valve settings. The multilateral well produces multiple fluids from a reservoir. The methods include determining, based on pressure and flow rate data of the multilateral well corresponding to each choke valve setting, a calibrated inflow performance relationship and a calibrated vertical lift performance relationship. For each sensitivity case of multiple sensitivity cases, the methods include determining a simulated operating point based on the calibrated inflow performance relationship, the calibrated vertical lift performance relationship, and the sensitivity case, in which the simulated operating point is an intersection point of a simulated inflow performance relationship and a simulated vertical lift performance relationship. The methods include measuring, during fluid production, a particular flowing bottom hole pressure, a particular surface pressure, and a particular reservoir pressure, and predicting flow rates of one or more fluids produced by the multilateral well based on an output of an optimizer, in which the optimizer determines the flow rates based on one or more sensitivity cases with similar associated pressures and associated flow rates. The methods include modifying, based on the one or more predicted flow rates, one or more properties of the multilateral well to optimize a respective fluid production rate.

In an example implementation combinable with any other implementation, for each choke valve setting of the multiple choke valve settings, determining the pressure and the flow rate data of the multilateral well includes (i) flowing fluids from a reservoir through one or more lateral wells and a common tubing of the multilateral well to a wellhead, (ii) measuring, by a pressure gauge configured to measure a pressure of fluid flowing through a first lateral well of the multilateral well, a flowing bottom hole pressure, (iii) measuring, by a pressure gauge configured to measure a pressure of fluid flowing through the common tubing, a surface pressure, (iv) determining a static reservoir pressure during a period of time in which fluids do not flow from the reservoir, and (v) measuring, by a portable fluid separator configured to isolate one or more fluids of multiple fluids, a surface flow rate of each fluid, wherein the portable fluid separator is hydraulically connected to the common tubing at the surface of the multilateral well.

In an example implementation combinable with any other implementation, the static reservoir pressure is determined by either a pressure gauge in the same well during static conditions, or a pressure gauge of a different well in a region, wherein the wells are configured to extract fluids from the reservoir.

In an example implementation combinable with any other implementation, the multiple fluids include water, gas, and oil.

In an example implementation combinable with any other implementation, the first lateral well is a lateral well of the multilateral well with a connection to the common tubing that is closer to the wellhead than any other connection to the common tubing associated with any other lateral well.

In an example implementation combinable with any other implementation, determining the inflow performance relationship includes (i) measuring a surface flow rate for a hydrocarbon fluid using a portable fluid separator for each choke valve setting, (ii) measuring a bottom hole pressure for each choke valve setting using the pressure gauge configured to measure the pressure of fluid flowing through the first lateral well of the multilateral well, (iii) determining one or more physical properties of the one or more fluids, in which the physical properties include density and viscosity, in which the inflow performance relationship is a relationship between the surface flow rate of the multiple fluids and the pressure drop from the reservoir pressure to the bottom hole pressure.

In an example implementation combinable with any other implementation, determining the vertical lift performance relationship includes (i) measuring a surface flow rate of the multiple fluids, using a portable fluid separator, (ii) measuring a surface pressure for each choke valve setting, (iii) measuring a bottom hole pressure using a pressure gauge configured to measure the pressure of fluid flowing through the first lateral well of the multilateral well, (iv) determining one or more physical properties of the one or more fluids, wherein the physical properties include density and viscosity, in which the vertical lift performance relationship is a relationship between the surface flow rate of the plurality of fluids and the pressure drop from the bottom hole pressure to the surface pressure.

In an example implementation combinable with any other implementation, in which for each choke valve setting, determining the flow rate data includes determining a well completion of the multilateral well. The well completion includes at least one or more reference points. Determining the flow rate data includes determining a fluid model of the plurality of the fluids, wherein the fluid model is based on PVT data, the PVT data measured in relation to one or more nearby wells.

In an example implementation combinable with any other implementation, predicting, by the optimizer, the one or more flow rates of the fluids produced by the multilateral well comprises determining a minimum difference between one or more of the particular pressures measured during fluid production and one or more simulated pressures, wherein the simulated pressures are determined by at least one relationship selected from the simulated inflow performance relationship and the simulated vertical lift performance relationship.

In an example implementation combinable with any other implementation, each sensitivity case comprises a distinct set of parameters that include one or more of reservoir parameters, fluid parameters, or well parameters.

In an example implementation combinable with any other implementation, the multilateral well produces fluids in a high gas-oil-ratio environment.

What is claimed is:

1. A method for determining fluid production rates in a high gas-oil-ratio environment from a multilateral well, the method comprising:

receiving pressure and flow rate data from the multilateral well, the data received at a plurality of choke valve settings, the multilateral well producing a plurality of fluids from a reservoir, wherein for each choke valve setting, determining the pressure and flow rate data comprises:

determining a well completion of the multilateral well, the well completion comprising at least one or more reference points; and determining a fluid model of the plurality of fluids, wherein the fluid model is based on pressure-volume-temperature (PVT) data, the PVT data measured in relation to one or more nearby wells;

determining, based on the pressure and flow rate data of the multilateral well corresponding to each choke valve setting, a calibrated inflow performance relationship and a calibrated vertical lift performance relationship;

for a plurality of sensitivity cases, wherein each sensitivity case of the plurality of sensitivity cases comprises a distinct set of parameters that include one or more of reservoir parameters, fluid parameters, and well parameters, determining a simulated operating point based on the calibrated inflow performance relationship, the calibrated vertical lift performance relationship, and the respective sensitivity case, wherein the simulated operating point is an intersection point of a simulated inflow performance relationship and a simulated vertical lift performance relationship;

measuring, during fluid production, a particular flowing bottom hole pressure, a particular surface pressure, and a particular reservoir pressure;

predicting flow rates of one or more fluids produced by the multilateral well based on an output of an optimizer, wherein the optimizer determines the flow rates based on one or more sensitivity cases with similar associated pressures and associated flow rates; and modifying, based on the one or more predicted flow rates, one or more properties of the multilateral well to optimize a respective fluid production rate.

2. The method of claim 1, wherein the plurality of fluids includes water, gas, and oil.

3. The method of claim 1, wherein predicting, by the optimizer, the one or more flow rates of the fluids produced by the multilateral well comprises determining a minimum difference between one or more of the particular pressures measured during fluid production and one or more simulated pressures, wherein the simulated pressures are determined by at least one relationship selected from the simulated inflow performance relationship and the simulated vertical lift performance relationship.

4. The method of claim 1, wherein the multilateral well produces fluids in a high gas-oil-ratio environment.

5. The method of claim 1, wherein for each choke valve setting of the plurality of choke valve settings, determining the pressure and the flow rate data of the multilateral well comprises:

flowing fluids from a reservoir through one or more lateral wells and a common tubing of the multilateral well to a wellhead;

measuring, by a pressure gauge configured to measure a pressure of fluid flowing through a first lateral well of the multilateral well, a flowing bottom hole pressure;

measuring, by a pressure gauge configured to measure a pressure of fluid flowing through the common tubing, a surface pressure;

determining a static reservoir pressure during a period of time in which fluids do not flow from the reservoir; and measuring, by a portable fluid separator configured to isolate one or more fluids of a plurality of fluids, a surface flow rate of each fluid, wherein the portable fluid separator is hydraulically connected to the common tubing at the surface of the multilateral well.

6. The method of claim 5, wherein the static reservoir pressure is determined by either a pressure gauge in the same well during static conditions, or a pressure gauge of a different well in a region, wherein the wells are configured to extract fluids from the reservoir.

7. The method of claim 5, wherein the first lateral well is a lateral well of the multilateral well with a connection to the common tubing that is closer to the wellhead than any other connection to the common tubing associated with any other lateral well.

8. The method of claim 5, wherein determining the inflow performance relationship comprises:

measuring a surface flow rate for a hydrocarbon fluid using a portable fluid separator for each choke valve setting; and measuring a bottom hole pressure for each choke valve setting using the pressure gauge configured to measure the pressure of fluid flowing through the first lateral well of the multilateral well; and determining one or more physical properties of the one or more fluids, wherein the physical properties include density and viscosity;

wherein the inflow performance relationship is a relationship between the surface flow rate of the plurality of fluids and the pressure drop from the reservoir pressure to the bottom hole pressure.

9. The method of claim 5, wherein determining the vertical lift performance relationship comprises:

measuring a surface flow rate of the plurality of fluids, using a portable fluid separator;

measuring a surface pressure for each choke valve setting;

measuring a bottom hole pressure using a pressure gauge configured to measure the pressure of fluid flowing through the first lateral well of the multilateral well;

determining one or more physical properties of the one or more fluids, wherein the physical properties include density and viscosity; and determining one or more characteristics of the multilateral well, the one or more characteristics selected from tubing size, tubing length, tubing geometry, vertical depth of the well, and an elevation difference between the reservoir and the surface;

wherein the vertical lift performance relationship is a relationship between the surface flow rate of the plurality of fluids and the pressure drop from the bottom hole pressure to the surface pressure.

10. A system for determining fluid production rates in a high gas-oil-ratio environment from a multilateral well, the system comprising:

at least one processor;

a memory storing instructions that, when executed by the at least one processor, cause the at least one processor to perform operations comprising:

receiving pressure and flow rate data from the multilateral well, the data received at a plurality of choke valve settings, the multilateral well producing a plurality of fluids from a reservoir, the plurality of fluids including water, gas, and oil, wherein the multilateral well produces fluids in a high gas-oil-ratio environment, wherein for each choke valve setting, determining the pressure and flow rate data comprises:

determining a well completion of the multilateral well, the well completion comprising at least one or more reference points; and determining a fluid model of the plurality of fluids, wherein the fluid model is based on pressure-volume-temperature (PVT) data, the PVT data measured in relation to one or more nearby wells;

determining, based on the pressure and flow rate data of the multilateral well corresponding to each choke valve setting, a calibrated inflow performance relationship and a calibrated vertical lift performance relationship;

for a plurality of sensitivity cases, wherein each sensitivity case of the plurality of sensitivity cases comprises a distinct set of parameters that include one or more of reservoir parameters, fluid parameters, and well parameters, determining a simulated operating point based on the calibrated inflow performance relationship, the calibrated vertical lift performance relationship, and the respective sensitivity case, wherein the simulated operating point is an intersection point of a simulated inflow performance relationship and a simulated vertical lift performance relationship;

measuring, during fluid production, a particular flowing bottom hole pressure, a particular surface pressure, and a particular reservoir pressure;

predicting flow rates of one or more fluids produced by the multilateral well based on an output of an optimizer, wherein the optimizer determines the flow rates based on one or more sensitivity cases with similar associated pressures and associated flow rates; and modifying, based on the one or more predicted flow rates, one or more properties of the multilateral well to optimize a respective fluid production rate.

11. The system of claim 10, wherein predicting, by the optimizer, the one or more flow rates of the fluids produced by the multilateral well comprises determining a minimum difference between one or more of the particular pressures measured during fluid production and one or more simulated pressures, wherein the simulated pressures are determined by at least one relationship selected from the simulated inflow performance relationship and the simulated vertical lift performance relationship.

12. The system of claim 10, wherein for each choke valve setting of the plurality of choke valve settings, determining the pressure and the flow rate data of the multilateral well comprises:

flowing fluids from a reservoir through one or more lateral wells and a common tubing of the multilateral well to a wellhead;

measuring, by a pressure gauge configured to measure a pressure of fluid flowing through a first lateral well of the multilateral well, a flowing bottom hole pressure;

measuring, by a pressure gauge configured to measure a pressure of fluid flowing through the common tubing, a surface pressure;

determining a static reservoir pressure during a period of time in which fluids do not flow from the reservoir; and measuring, by a portable fluid separator configured to isolate one or more fluids of a plurality of fluids, a surface flow rate of each fluid, wherein the portable fluid separator is hydraulically connected to the common tubing at the surface of the multilateral well.

13. The system of claim 12, wherein the static reservoir pressure is determined by either a pressure gauge in the same well during static conditions, or a pressure gauge of a different well in a region, wherein the wells are configured to extract fluids from the reservoir.

14. The system of claim 12, wherein the first lateral well is a lateral well of the multilateral well with a connection to the common tubing that is closer to the wellhead than any other connection to the common tubing associated with any other lateral well.

15. The system of claim 12, wherein determining the inflow performance relationship comprises:

measuring a surface flow rate for a hydrocarbon fluid using a portable fluid separator for each choke valve setting; and measuring a bottom hole pressure for each choke valve setting using the pressure gauge configured to measure the pressure of fluid flowing through the first lateral well of the multilateral well; and determining one or more physical properties of the one or more fluids, wherein the physical properties include density and viscosity;

wherein the inflow performance relationship is a relationship between the surface flow rate of the plurality of fluids and the pressure drop from the reservoir pressure to the bottom hole pressure.

16. The system of claim 12, wherein determining the vertical lift performance relationship comprises:

measuring a surface flow rate of the plurality of fluids, using a portable fluid separator;

measuring a surface pressure for each choke valve setting;

measuring a bottom hole pressure using a pressure gauge configured to measure the pressure of fluid flowing through the first lateral well of the multilateral well;

determining one or more physical properties of the one or more fluids, wherein the physical properties include density and viscosity; and determining one or more characteristics of the multilateral well, the one or more characteristics selected from tubing size, tubing length, tubing geometry, vertical depth of the well, and an elevation difference between the reservoir and the surface;

wherein the vertical lift performance relationship is a relationship between the surface flow rate of the plurality of fluids and the pressure drop from the bottom hole pressure to the surface pressure.

* * * * *